US010226801B2

(12) United States Patent
Imai et al.

(10) Patent No.: US 10,226,801 B2
(45) Date of Patent: Mar. 12, 2019

(54) CASTING PRODUCT REDUCTION APPARATUS

(71) Applicant: NIPPON STEEL & SUMITOMO METAL CORPORATION, Tokyo (JP)

(72) Inventors: Shuntaro Imai, Tokyo (JP); Yasuo Maruki, Tokyo (JP); Norimasa Yamasaki, Tokyo (JP); Yukihiro Matsuoka, Kitakyushu (JP); Satoshi Senoo, Kitakyushu (JP); Masanobu Hayama, Kitakyushu (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 1068 days.

(21) Appl. No.: 14/371,961

(22) PCT Filed: Jan. 15, 2013

(86) PCT No.: PCT/JP2013/050592
§ 371 (c)(1),
(2) Date: Jul. 11, 2014

(87) PCT Pub. No.: WO2013/105670
PCT Pub. Date: Jul. 18, 2013

(65) Prior Publication Data

US 2015/0047403 A1 Feb. 19, 2015

(30) Foreign Application Priority Data

Jan. 12, 2012 (JP) ..... 2012-004101
Jun. 18, 2012 (JP) ..... 2012-137020

(51) Int. Cl.
*B21D 11/12* (2006.01)
*B21B 1/46* (2006.01)
(Continued)

(52) U.S. Cl.
CPC ..... *B21B 1/46* (2013.01); *B21B 27/02* (2013.01); *B21B 31/02* (2013.01); *B22D 11/128* (2013.01)

(58) Field of Classification Search
CPC ..... B21B 1/46; B21B 31/02; B21B 27/02; B22D 11/128
(Continued)

(56) References Cited

U.S. PATENT DOCUMENTS 5,115,857 A * 5/1992 Schertler ..... B22D 11/128 164/442
5,348,074 A 9/1994 Streubel
(Continued)

FOREIGN PATENT DOCUMENTS

CN 8-257715 A 10/1996
CN 1253864 A 5/2000
(Continued)

OTHER PUBLICATIONS

International Search Report, dated Feb. 19, 2013, issued in PCT/JP2013/050592.
(Continued)

*Primary Examiner* — David B Jones
(74) *Attorney, Agent, or Firm* — Birch, Stewart, Kolasch & Birch, LLP

(57) ABSTRACT

The present invention is a casting product reduction apparatus that applies reduction to a casting product drawn from a mold with a sufficient reduction force and thereby can surely decrease center segregation and porosity and suppress occurrence of internal cracks so as to manufacture a high-quality casting product and includes: a pair of casting product press rolls that hold and press the casting product therebetween; backup rolls that support the casting product press rolls; and a pair of frames arranged to face each other,
(Continued)

wherein three or more sets of the casting product press roll and the backup roll are arranged in a casting product drawing direction on each of the frames, and wherein a reduction means that decreases and increases a distance between the frames is provided at two or more places on the pair of frames.

7 Claims, 16 Drawing Sheets

(51) Int. Cl.
*B22D 11/128* (2006.01)
*B21B 27/02* (2006.01)
*B21B 31/02* (2006.01)

(58) Field of Classification Search
USPC ..... 72/227
See application file for complete search history.

(56) References Cited

U.S. PATENT DOCUMENTS

| | | | | |
|---|---|---|---|---|
| 5,839,502 | A * | 11/1998 | Ayata | B22D 11/1206 164/476 |
| 6,199,621 | B1 | 3/2001 | Weyer et al. | |
| 6,725,701 | B2 * | 4/2004 | Nakayama | B21B 13/147 72/237 |
| 2002/0005266 | A1 | 1/2002 | Pleschiutschnigg et al. | |
| 2004/0123972 | A1 * | 7/2004 | Masui | B22D 11/128 164/442 |
| 2009/0314455 | A1 | 12/2009 | Reifferscheid et al. | |

FOREIGN PATENT DOCUMENTS

| | | | |
|---|---|---|---|
| CN | 101219463 | A | 7/2008 |
| CN | 102389957 | A | 3/2012 |
| JP | 51-78738 | | 7/1976 |
| JP | 54-45217 | | 3/1979 |
| JP | 55-10400 | A | 1/1980 |
| JP | 56-128651 | A | 10/1981 |
| JP | 58-185356 | U | 12/1983 |
| JP | 61-132249 | A | 6/1986 |
| JP | 1-39863 | B2 | 8/1989 |
| JP | 6-210420 | A | 8/1994 |
| JP | 8-132205 | A | 5/1996 |
| JP | 8-238550 | A | 9/1996 |
| JP | 10-328799 | A | 12/1998 |
| JP | 11-291007 | A | 10/1999 |
| JP | 2000-312956 | A | 11/2000 |
| JP | 2003-94154 | A | 4/2003 |
| JP | 2007-83279 | A | 4/2007 |
| JP | 2009-279652 | A | 12/2009 |
| JP | 2011-56552 | A | 3/2011 |
| JP | 2012-240058 | A | 12/2012 |

OTHER PUBLICATIONS

Written Opinion of the International Searching Authority, dated Feb. 19, 2013, issued in PCT/JP2013/050592.
Canadian Office Action for Canadian Application No. 2,860,497, dated May 24, 2016.
Extended European Search Report for European Application No. 13736021.0, dated Dec. 3, 2015.
Chinese Office Action and Search Report, dated Jun. 26, 2015, for corresponding Chinese Application No. 201380005164.7, with a partial English translation of the Office Action.
Korean Office Action, dated Jul. 27, 2015, for corresponding Korean Application No. 10-2014-7019938, with a partial English translation.
European Communication Pursuant to Article 94(3) EPC for corresponding European Application No. 13736021.0, dated Mar. 28, 2018.
Brazilian Office Action and Search Report dated Nov. 6, 2018, published in Brazilian Industrial Property Journal No. 2497 dated Nov. 13, 2018, in corresponding Patent Application No. BR112014016984-5 (with English translation).

* cited by examiner

CASTING PRODUCT REDUCTION APPARATUS

TECHNICAL FIELD

The present invention relates to a casting product reduction apparatus for applying reduction to a casting product drawn from a mold, in a thickness direction of the casting product.

This application is based upon and claims the benefit of priority of the prior Japanese Patent Application No. 2012-4101, filed in Japan on Jan. 12, 2012, and Japanese Patent Application No. 2012-137020, filed in Japan on Jun. 18, 2012, the entire contents of which are incorporated herein by reference.

BACKGROUND ART

For example, in continuous casting for steel, molten steel poured into a mold is cooled by a cooling means, whereby solidified shell grows and a casting product is drawn from below the mold. Here, the casting product drawn from the mold has not completely solidified at the point in time when coming out of the mold but has an unsolidified portion therein. Therefore, there is a possibility that so-called bulging deformation of the casting product being deformed to bulge out occurs due to static pressure of the molten steel in the mold. It is known that center segregation occurs at a region where the bulging deformation occurs.

To suppress the bulging deformation, continuous casting facilities provided with casting product support rolls that come into contact with long side surfaces of the casting product drawn from the mold and receive the aforementioned static pressure are suggested, for example, in Patent Documents 1, 2.

Here, to surely support the long side surfaces of the casting product, it is effective to decrease the roll diameter and decrease the interval between the casting product support rolls. However, if the roll diameter is decreased, the casting product support roll becomes insufficient in stiffness and deformed to deflect due to the static pressure, thus failing to surely support the casting product.

Hence, in Patent Documents 1, 2, backup rolls that support the casting product support rolls are arranged to prevent the aforementioned casting product support rolls from being deformed due to the static pressure.

Further, porosity may occur inside the casting product due to solidification contraction or the like. The porosity can be decreased by applying strong rolling reduction to the casting product during hot rolling, but the rolling reduction amount during the hot rolling cannot be secured to fail to sufficiently decrease the porosity in the case of a product with a large thickness.

Hence, to suppress the occurrence of porosity at the stage of the casting product, a roll segment apparatus that applies rolling reduction to the casting product is suggested, for example, in Patent Document 3. In this roll segment apparatus, a reduction means that brings a lower frame and an upper frame closer to each other and thereby can apply reduction to the casting product.

Here, in the roll segment apparatus described in Patent Document 3, a roll in contact with the casting product is composed of divided rolls divided in a roll axial direction, and bearing parts that pivotally support the divided rolls are arranged between divided rolls adjacent in the axial direction. This structure makes it possible to receive a load applied on the roll by a plurality of bearing parts in a distributed manner, and to apply reduction to the casting product with a large rolling reduction force to decrease the porosity.

PRIOR ART DOCUMENT

Patent Document

Patent Document 1 Japanese Laid-open Patent Publication No. H10-328799

Patent Document 2 Japanese Laid-open Patent Publication No. H11-291007

Patent Document 3 Japanese Laid-open Patent Publication No. 2000-312956

DISCLOSURE OF THE INVENTION

Problems to be Solved by the Invention

However, in the case where the roll in contact with the casting product is divided in the roll axial direction, it becomes impossible to apply reduction to the casting product any longer at the bearing parts arranged between the divided rolls adjacent in the axial direction, leading to a possibility that the bulging deformation occurs at the bearing parts. The bulging deformation could not be fully corrected even by pressing thereafter the place where the bulging deformation has occurred using other divided rolls. Therefore, center segregation and porosity occur to degrade the quality of the casting product.

On the other hand, in the case where the divided rolls are not employed, the load applied on a roll is received by two bearing parts, and therefore it is impossible to apply reduction to the casting product with a large reduction force and sufficiently decrease the porosity.

Further, in a casting product support apparatus in which the backup rolls are arranged for the casting product support rolls, it is possible to decrease the bulging deformation and decrease the center segregation, but it is impossible to sufficiently decrease the porosity because the casting product is not subjected to reduction.

Further, in the case where the stiffness of the roll is improved by increasing the roll diameter of the roll in contact with the casting product, rolls need to be arranged at a distance in the casting product drawing direction. This increases the bulging deformation and causes a possibility that the center segregation occurs. In addition, reduction is locally applied to the casting product, causing a possibility that internal cracks occur in the casting product.

As described above, it is impossible to simultaneously decrease the center segregation and the porosity of the casting product in the prior art.

The present invention has been made in consideration of the above situation and its object is to provide a casting product reduction apparatus that applies reduction to a casting product drawn from a mold with a sufficient reduction force and thereby can surely decrease center segregation and porosity and suppress occurrence of internal cracks so as to manufacture a high-quality casting product.

Means for Solving the Problems

To achieve the above object, a casting product reduction apparatus according to the present invention is a casting product reduction apparatus for applying reduction to a casting product drawn from a mold, including: a pair of casting product press rolls that hold and press the casting product therebetween; backup rolls that support the casting product press rolls; and a pair of frames arranged to face each other, wherein three or more sets of the casting product press roll and the backup roll are arranged in a casting product drawing direction on each of the frames, and wherein a rolling reduction means that decreases and increases a distance between the pair of frames is provided at two or more places on the pair of frames.

The casting product reduction apparatus with this structure includes the casting product press rolls and the backup rolls that support the casting product press rolls, so that bearing parts of the casting product press rolls and bearing parts of the backup rolls can receive the load applied when applying reduction to the casting product. Consequently, it becomes possible to apply reduction to the casting product with a relatively large reduction force and sufficiently decrease the porosity.

Further, it is possible to sufficiently press the whole casting product in the width direction and suppress occurrence of center segregation without making the casting product press roll into divided rolls.

Further, it is unnecessary to increase the stiffness of the casting product press roll by increasing the roll diameter, and it is thus possible to arrange the casting product press rolls at a small pitch in the casting product drawing direction and relatively uniformly apply reduction to the casting product so as to suppress internal cracks in the casting product.

Further, three or more sets of the casting product press roll and the backup roll are arranged in the casting product drawing direction on each of the frames, and a reduction means is provided at two or more places on the frames, so that the three or more sets of the casting product press roll and the backup roll can uniformly apply reduction to the casting product.

Here, it is preferable that one of the casting product press rolls forming a pair across the casting product has a large-diameter portion projecting outward in a diameter direction at a middle portion in an axial direction.

This makes it possible to apply reduction to the middle region in the width direction of the casting product where an unsolidified portion exists by the large-diameter portion, and not to apply reduction to completely solidified end portions in the width direction of the casting product. Consequently, the reduction load can be decreased.

Further, the casting product press roll is supported by the backup roll, so that even if the stiffness of the casting product press roll is low, the deflection deformation in the reduction direction of the casting product press roll can be suppressed. Consequently, the casting product press roll having the large-diameter portion projecting outward in the diameter direction at the middle portion in the axial direction can be applied even to a relatively wide casting product such as a slab.

Furthermore, the casting product press roll is not pressed against the completely solidified end portions in the width direction of the casting product as described above, whereby it also becomes possible to suppress the deflection deformation in the drawing direction of the casting product press roll.

Here, it is preferable that the backup roll is divided into a plurality of parts in an axial direction of the casting product press roll.

In this case, since the backup roll is divided into a plurality of parts in a roll axial direction, bearing parts are arranged between the divided backup rolls. Therefore, a plurality of bearing parts can receive the load applied on the backup roll via the casting product press roll, whereby it becomes possible to apply reduction to the casting product with a larger reduction force and surely decrease the porosity.

Further, it is preferable that the backup roll is arranged inside in the width direction of the large-diameter portion of the casting product press roll. The casting product press roll comes into uniform contact with the backup roll to make the abrasion of the backup roll uniform.

Further, it is preferable that the backup roll is arranged on a downstream side in a drawing direction of the casting product with respect to the casting product press roll.

In this case, the backup roll arranged on the downstream side in the drawing direction with respect to the casting product press roll can receive a drawing resistance so as to suppress deflection deformation in the drawing direction of the casting product press roll. Note that in the case where the backup roll is divided, at least one of the divided backup rolls only needs to be arranged on the downstream side in the drawing direction with respect to the casting product press roll.

Further, it is adoptable that the backup roll is divided in an axial direction of the casting product press roll, and at least one backup roll is arranged on a downstream side in a drawing direction of the casting product and at least one backup roll is arranged on an upstream side in the drawing direction of the casting product.

If the casting speed (drawing speed of the casting product) is changed depending on the operation status, the drawing resistance acting on the casting product press roll also changes. Therefore, the deflection amount in the drawing direction of the casting product press roll varies to cause bending variation in the casting product press roll.

In this regard, as described above, provision of the plurality of divided backup rolls makes it possible to support the casting product press roll from the upstream side and the downstream side in the drawing direction to suppress the aforementioned bending variation of the casting product press roll.

Further, it is preferable that where a thickness of the casting product is t, an end region in a width direction of the casting product which is not subjected to reduction by the large-diameter portion of the casting product press roll is a region of 60 mm or more from an end in the width direction of the casting product and 1.5×t or less from the end in the width direction of the casting product.

In this case, since the completely solidified end portions in the width direction of the casting product are not subjected to rolling reduction, the rolling reduction load can be decreased. Further, the deflection deformation in the reduction direction and the deflection deformation in the drawing direction of the casting product press roll can be suppressed.

It was found from the experimental knowledge that if the end region in the width direction of the casting product which was not subjected to reduction by the large-diameter portion was less than 60 mm from the end in the width direction of the casting product, the reduction load could not be sufficiently decreased regardless of the thickness of the casting product, so that it was hard to suppress the deflection deformation in the rolling reduction direction and the deflection deformation in the drawing direction of the casting product press roll.

On the other hand, it was found from the experimental knowledge that the width of the solidified region at the end portion in the width direction of the casting product was 1.5×t at maximum in the vicinity of a solidified end portion in a casting direction requiring reduction. Therefore, when the end region in the width direction of the casting product which is not subjected to reduction by the large-diameter portion exceeds 1.5×t from the end in the width direction of the casting product, it becomes hard to apply reduction to the whole unsolidified portion in the width direction, resulting in occurrence of bulging deformation in the casting product to tend to lead to internal defects such as center segregation and porosity.

Effect of the Invention

As described above, according to the present invention, it is possible to provide a casting product reduction apparatus that applies reduction to a casting product drawn from a mold with a sufficient reduction force and thereby can surely decrease center segregation and porosity and suppress occurrence of internal cracks so as to manufacture a high-quality casting product.

MODE FOR CARRYING OUT THE INVENTION

Hereinafter, a casting product reduction apparatus that is an embodiment of the present invention will be described referring to the accompanying drawings. Note that the present invention is not limited to the following embodiments.

Figure 1:
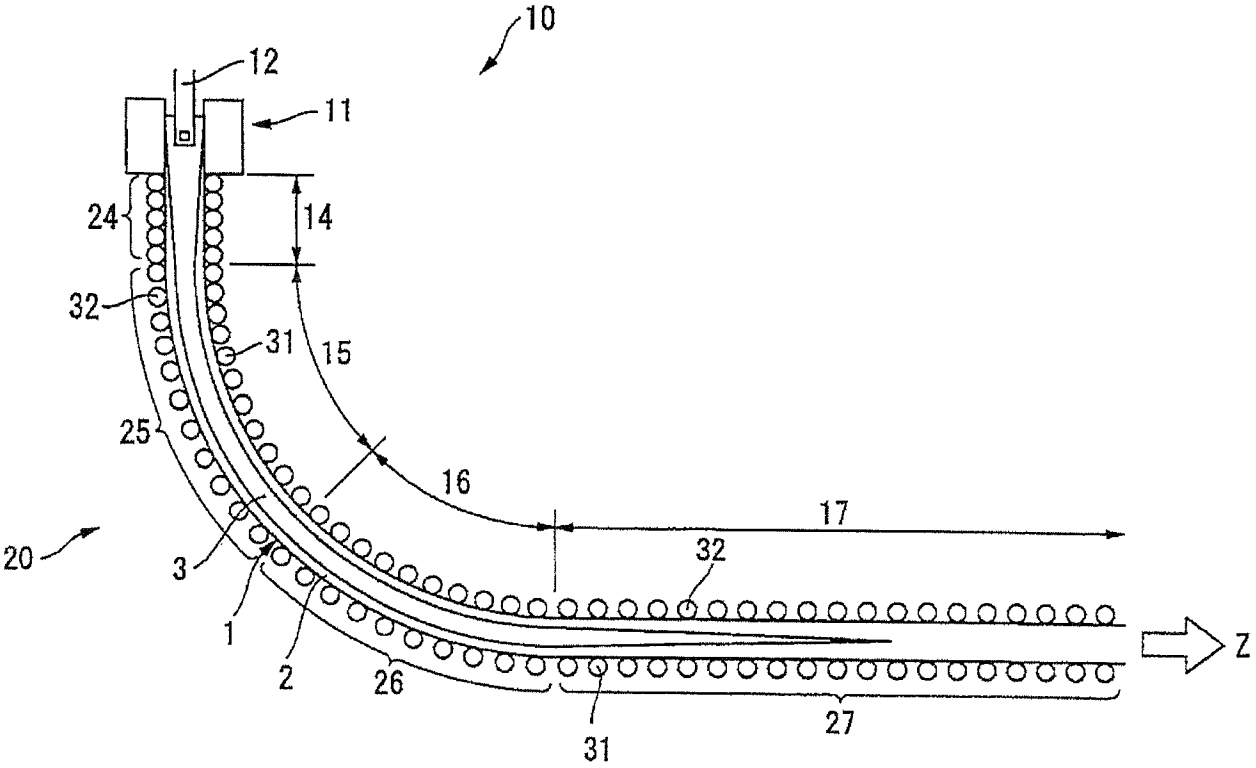
FIG. 1 A schematic explanatory view of a continuous casting equipment in which a casting product reduction apparatus being an embodiment of the present invention is arranged.

The casting product reduction apparatus being this embodiment is used arranged in a continuous casting equipment 10 illustrated in FIG. 1. The continuous casting equipment 10 will be described first.

This continuous casting equipment 10 includes a water-cooled mold 11 and a casting product support roll group 20 located below the water-cooled mold 11, and is configured as a vertical bending continuous casting machine that has a vertical zone 14 that draws downward a casting product 1 drawn from the water-cooled mold 11, a bending zone 15 that bends the casting product 1, a straightening zone 16 that bends back the bent casting product 1, and a horizontal zone 17 that conveys the casting product 1 in the horizontal direction.

The water-cooled mold 11 is in a cylindrical shape having a rectangular hole, and the casting product 1 having a cross section according to the shape of the rectangular hole is drawn out. For example, a water-cooled mold with a long side length of the rectangular hole (corresponding to the width of the casting product 1) set to 700 to 2300 mm and a short side length of the rectangular hole (corresponding to the thickness of the casting product 1) set to 150 to 400 mm can be exemplified, but the water-cooled mold 11 is not limited to this.

The water-cooled mold 11 is further provided with a primary cooling means (not illustrated) for cooling molten steel in the rectangular hole.

The casting product support roll group 20 includes a pinch roll part 24 located at the vertical zone 14, a bending roll part 25 located at the bending zone 15, a straightening roll part 26 located at the straightening zone 16, and a horizontal roll part 27 located at the horizontal zone 17.

Here, the casting product support roll group 20 is configured to support long side surfaces of the casting product 1.

Further, spray nozzles (not illustrated) that spray cooling water toward the long side surfaces of the casting product 1 are arranged as secondary cooling means, in the continuous casting equipment 10.

The casting product reduction apparatus being this embodiment is intended to apply reduction to the casting product 1 drawn from the water-cooled mold 11, in a direction of the thickness of the casting product 1, and is arranged at the horizontal zone 17 so as to apply reduction to the casting product 1 in a region where a center solid phase ratio of the casting product 1 is 0.2 or more. However, the casting product reduction apparatus is not limited to this.

Figure 2:
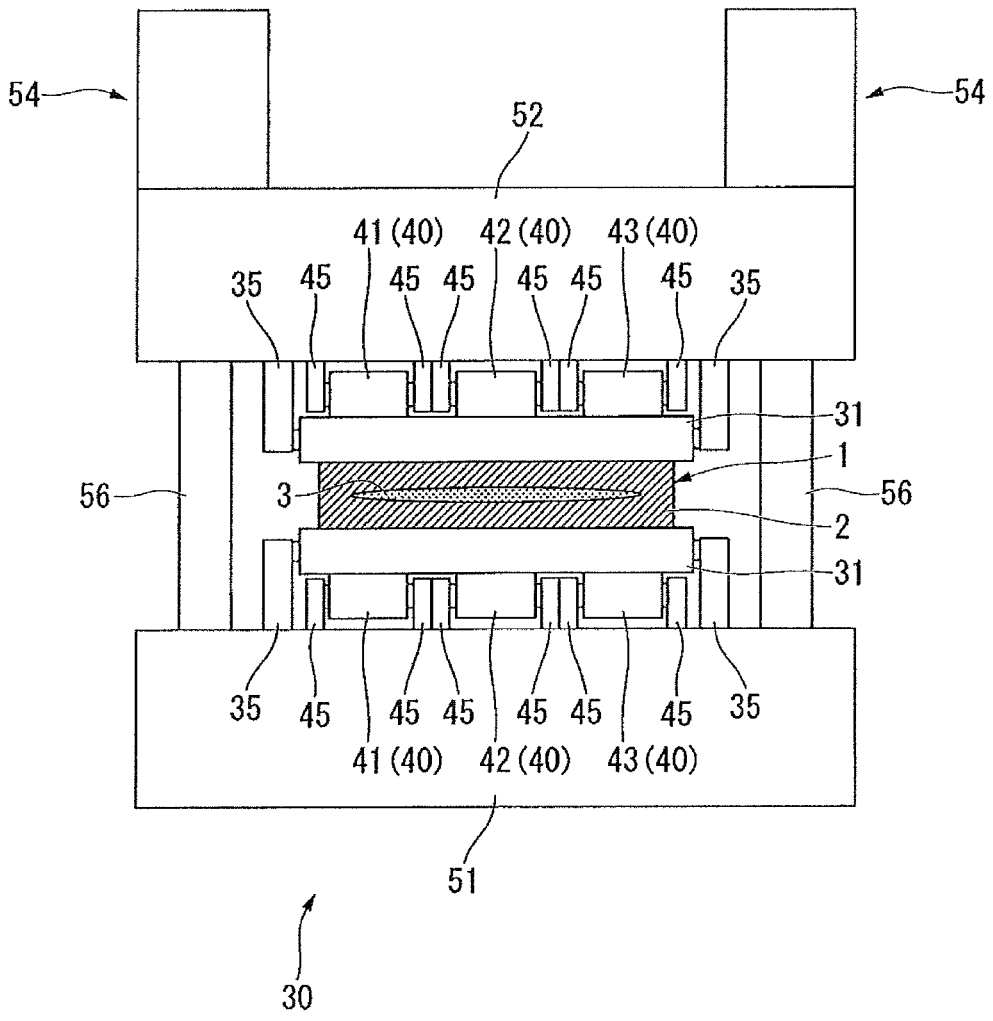
FIG. 2 A front explanatory view of the casting product reduction apparatus being the embodiment of the present invention.
Figure 3:
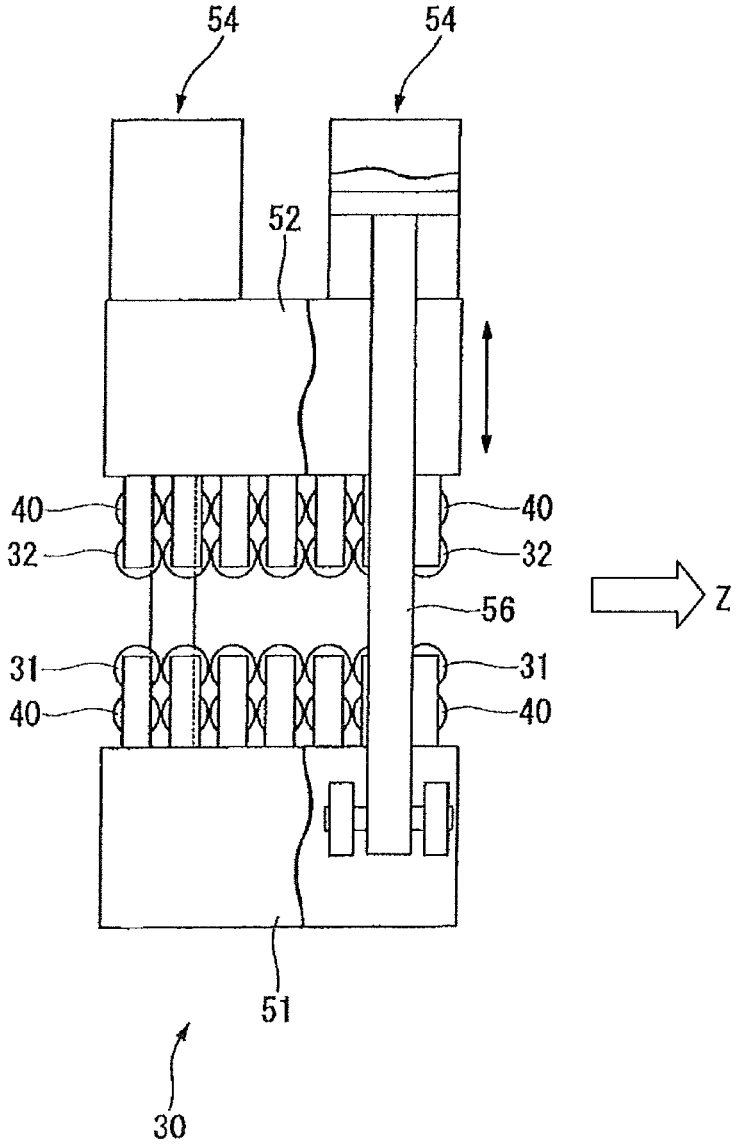
FIG. 3 A partial cross-sectional explanatory view of the casting product reduction apparatus being the embodiment of the present invention.

A casting product reduction apparatus 30 includes, as illustrated in FIG. 2 and FIG. 3, casting product press rolls 31, 32 that come into contact with the long side surfaces of the casting product 1 and form a pair across the casting product 1, backup rolls 40 that support the casting product press rolls 31, 32, a first frame 51 that is arranged on one surface side of the casting product 1, and a second frame 52 that is arranged on the other surface side of the casting product 1.

On the first frame 51 and the second frame 52, three or more casting product press rolls 31, 32 are arranged in a casting product drawing direction Z respectively, and seven sets of casting product press rolls 31, 32 are arranged in this embodiment.

As illustrated in FIG. 2, the casting product press roll 31, 32 is configured such that its length in a roll axial direction is set to be larger than the long side width of the casting product 1. Further, the casting product press roll 31, 32 is pivotally supported by bearing parts 35 at both ends respectively, and is thereby rotatable around its center axis. Further, the roll gap between the casting product press roll 31 on the first frame 51 and the casting product press roll 32 on the second frame 52 is adjusted to get narrower as it goes to the downstream side in the casting product drawing direction Z.

Here, it is preferable in this embodiment that the roll diameter of the casting product press roll 31, 32 is set to 320 mm or less and the roll pitch in the casting product drawing direction Z is set to 340 mm or less.

Further, on the first frame 51 and the second frame 52, the backup rolls 40 that support the casting product press rolls 31, 32 respectively are arranged. More specifically, three or more sets of the casting product press roll 31 and the backup roll 40 are arranged on the first frame 51 and three or more sets of the casting product press roll 32 and the backup roll 40 are arranged on the second frame 52 in the casting product drawing direction, and seven sets of the casting product press rolls 31, 32 are arranged in this embodiment.

The backup roll 40 is divided into a plurality of parts in the axial direction of the casting product press roll 31, 32 (the width direction of the casting product 1) as illustrated in FIG. 2, and is divided into three parts, that is, a first backup roll 41, a second backup roll 42, and a third backup roll 43. Each of the first backup roll 41, the second backup roll 42, and the third backup roll 43 is pivotally supported by bearing parts 45 at both ends respectively, and is thereby rotatable around the center axis thereof.

The first frame 51 and the second frame 52 are coupled to each other by a plurality of reduction means 54. In this embodiment, as illustrated in FIG. 2 and FIG. 3, four reduction means 54 are provided, and the reduction means 54 provide a structure that the distance between the first frame 51 and the second frame 52 increases and decreases, and are thereby capable of adjusting the reduction force to the casting product 1.

The reduction means 54 is composed of, for example, a hydraulic cylinder with a servo, and is configured such that one end of a cylinder rod 56 is fixed to the first frame 51 and the second frame 52 gets closer to and away from the first frame 51.

In the continuous casting equipment 10 having the above structure, molten steel is poured into the water-cooled mold 11 via an immersion nozzle 12 inserted into the water-cooled mold 11 and cooled by the primary cooling means of the water-cooled mold 11, whereby a solidified shell 2 grows and the casting product 1 is drawn out from below the water-cooled mold 11. In this event, inside the casting product 1, an unsolidified portion 3 exists as illustrated in FIG. 1 and FIG. 2.

This casting product 1 is drawn out downward by the pinch roll part 24 and bent by the bending roll part 25 as illustrated in FIG. 1. Then, the casting product 1 is bent back by the straightening roll part 26 and then conveyed in the horizontal direction by the horizontal roll part 27.

In this event, the cooling water is sprayed toward the casting product 1 from the spray nozzles provided between the rolls of the pinch roll part 24, the bending roll part 25, the straightening roll part 26 and so on to cool the casting product 1, whereby the solidified shell 2 further grows. Then, at the side subsequent to the horizontal zone 17 where the casting product 1 is drawn out in the horizontal direction, the casting product 1 completely solidifies.

In this event, the casting product 1 drawn from the water-cooled mold 11 is subjected to reduction by the casting product reduction apparatus 30 being this embodiment in the region where the center solid phase ratio becomes 0.2 or more.

Incidentally, it is experimentally known that problems such as center segregation and porosity occur at the center solid phase ratio of the casting product of 0.2 or more. The effect of the present invention becomes conspicuous by applying reduction in a region of a solid phase ratio of 0.2 or more, and therefore it is preferable to apply rolling reduction in a region of a center solid phase ratio of the casting product of 0.2 or more.

On the other hand, the upper limit of the center solid phase ratio of the casting product is 1.0 because it is the region where the problems such as center segregation and porosity occur.

Note that the center solid phase ratio is defined as a solid phase ratio of a central portion in the casting product thickness direction and a molten portion in the casting product width direction.

Further, the center solid phase ratio can be found by a heat transfer solidification calculation, and the enthalpy method, the equivalent specific heat method and so on are widely known as the heat transfer solidification calculation, any of which may be used. Further, for a simple method, the following expression is widely known and may be used.

center solid phase ratio=(liquidus temperature−molten portion temperature)/(liquidus temperature−solidus temperature)

In the above, the molten portion temperature means the temperature of the central portion in the casting product thickness direction and the molten portion in the casting product width direction, and can be found by the heat transfer solidification calculation. Further, the liquidus temperature can be calculated by referring to, for example, "Tetsu to hagane, The journal of The Iron and Steel Institute of Japan, Vol. 55. No. 3 (19690227) S85, The Iron and Steel Institute of Japan", and the solidus temperature can be calculated by referring to, for example, "Hirai, Kanemaru, Mori: 19th Committee, Japan Society for the Promotion of Science, Fifth Solidification Phenomena Conference Material, Solidification 46 (December 1968)"

The casting product reduction apparatus 30 being this embodiment structured as described above includes the casting product press rolls 31, 32 and the backup rolls 40 that support the casting product press rolls 31, 32 respectively, so that the bearing parts 35 of the casting product press rolls 31, 32 and the bearing parts 45 of the backup rolls 40 can receive the load applied when applying reduction to the casting product 1. Consequently, it becomes possible to apply reduction to the casting product 1 with a relatively large reduction force and surely decrease the porosity.

Further, the casting product press roll 31, 32 is not divided in the roll axial direction and therefore can press the whole casting product 1 in the width direction and suppress occurrence of center segregation due to bulging deformation.

Further, according to the casting product reduction apparatus 30 in this embodiment, it is unnecessary to increase the roll diameter for securing the stiffness of the casting product press rolls 31, 32, and therefore it is possible to densely arrange the casting product press rolls 31, 32 in the casting product drawing direction Z to thereby prevent the reduction force from locally acting and suppress internal cracks of the casting product. More specifically, since the casting product press rolls 31, 32 are set to 320 mm or less and the roll pitch in the casting product drawing direction Z is set to 340 mm or less, it becomes possible to apply reduction to the casting product 1 little by little at a small pitch to thereby sufficiently suppress internal cracks of the casting product 1.

Note that the size of the casting product press rolls 31, 32 and the lower limit of the roll pitch in the casting product drawing direction Z are not particularly limited but may be set in a range where actual operation is possible.

Further, since three or more sets of the casting product press roll 31, 32 and the backup roll 40 (seven sets of the casting product press roll 31, 32 and the backup roll 40 as illustrated in FIG. 3 in this embodiment) are arranged in the casting product drawing direction Z on each of the first frame 51 and the second frame 52, and the reduction means 54 is provided at two or more places (at four places in this embodiment) on the first frame 51 and the second frame 52, the plurality of casting product press rolls 31, 32 can uniformly apply reduction to the casting product 1. Further, the bearing parts 35 arranged at the casting product press rolls 31, 32 can receive the reduction load.

Here, the reason why the number of sets of the casting product press roll 31, 32 and the backup roll 40 arranged on each frame is three or more in the casting product drawing direction Z is that if the size of the casting product press roll 31, 32 and the roll pitch in the casting product drawing direction Z are set in a range where actual operation is possible, two sets of them cannot uniformly apply reduction because of a large interval therebetween in the casting product drawing direction.

Further, it is necessary to provide the reduction means 54 on a pair of frames, at two places or more. Here, the two places means both sides in the width direction of the casting product, and the reduction means 54 on the pair of frames provided on both sides in the width direction of the casting product enable uniform application of reduction to the casting product.

Incidentally, the reduction means 54 is provided at two places also in the casting product drawing direction Z in addition to the two places on both sides in the width direction of the casting product, that is, at four places in total in this embodiment, so that a reduction gradient can also be given in the casting product drawing direction Z.

Further, since the reduction force can be increased only by increasing the size of the device (for example, the cylinder diameter) constituting the reduction means provided on the frames, it becomes possible to give a larger reduction force without increasing the size of the reduction apparatus in a casting direction.

Further, since the backup roll 40 is divided into a plurality of parts in the roll axial direction, not only the bearing parts 35 but also the plurality of bearing parts 45 arranged between the divided backup rolls 41, 42, 43 can also receive the reduction load, whereby it becomes possible to apply reduction to the casting product 1 with a larger reduction force to sufficiently decrease the porosity.

Incidentally, the number of divisions in the roll axial direction of the backup roll 40 only needs to be plural (two or more), and a case of the number of divisions of three is exemplified in this embodiment. The upper limit of the number of divisions is not limited but may be set in a range where actual operation is possible. As described above, according to the casting product reduction apparatus 30 being this embodiment, the high-quality casting product 1 can be manufactured in which occurrence of porosity, center segregation and internal cracks is suppressed.

The casting product reduction apparatus being the embodiment of the present invention has been described above, but the present invention is not limited to the embodiment and can variously modified as necessary without departing from the scope of the technical spirit of the invention.

For example, though the casting product reduction apparatus including the backup roll divided into a plurality of parts has been described in this embodiment, the casting product reduction apparatus is not limited to this but may include one backup roll which is not divided. However, by dividing the backup roll into a plurality of parts, it becomes possible to receive the reduction load in a distributed manner and apply reduction to the casting product with a larger reduction force, and therefore it is preferable to divide the backup roll into a plurality of parts.

Further, there is no limitation in the number of divisions of the backup roll, and a backup roll divided into two or four or more parts may be used.

Figure 4:
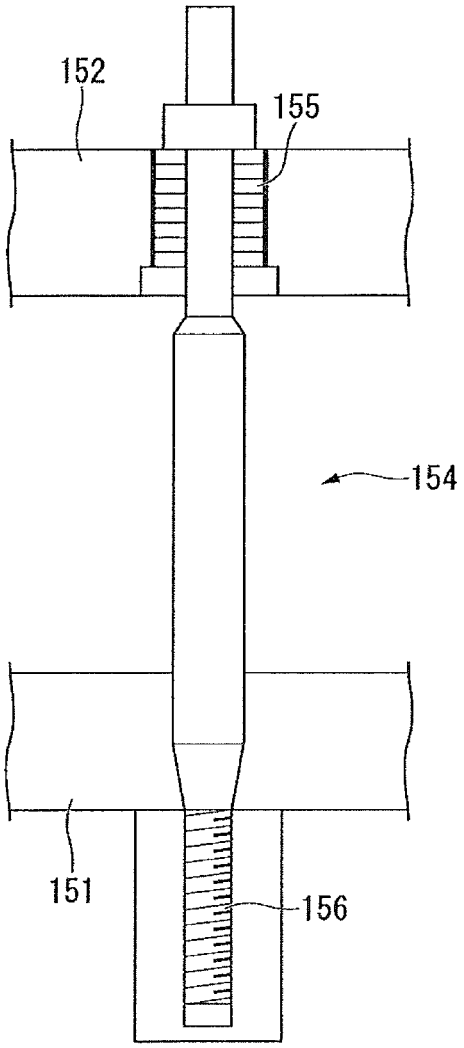
FIG. 4 An explanatory view of another reduction means employable in the casting product reduction apparatus being the embodiment of the present invention.

Further, the reduction means has been described as the one using a hydraulic cylinder but is not limited to this. For example, a mechanical reduction means 154 using a disc spring 155 and a screw jack 156 may be arranged on the first frame 151 and the second frame 152 as illustrated in FIG. 4.

Further, the casting product reduction apparatus has been described as being arranged in the vertical bending continuous casting machine, but may be applied to a curved continuous casting machine, a vertical continuous casting machine, or a horizontal continuous casting machine.

It is preferable to arrange the casting product reduction apparatus of the present invention at a position where bending strain or straightening strain does not occur in the casting product in the continuous casting machine.

The position where the bending strain or the straightening strain does not occur in the casting product means a position except for a bending part and a straightening part among a vertical part, a bending part, a curved part, a straightening part, and a horizontal part constituting the continuous casting equipment. By arranging the casting product reduction apparatus at the position, internal cracks of the casting product can be suppressed when applying reduction to the casting product.

Concretely, in the case of the vertical bending continuous casting equipment, the casting product reduction apparatus may be arranged at any position of the vertical part, the curved part, and the horizontal part. In the case of the curved continuous casting equipment, the casting product reduction apparatus may be arranged at any position of the curved part and the horizontal part. In the case of both of the horizontal continuous casting equipment and the vertical continuous casting equipment which do not have the bending part and the straightening part, the casting product reduction apparatus may be arranged at any position.

However, reduction applied to the casting product to a large extent at a position immediately after the casting product is drawn from the mold does not lead to improvement in center segregation and porosity but leads to occurrence of internal cracks because of low strength of the solidified shell. Therefore, there is generally a high possibility that the central solid phase ratio is 0 in a range of less than 2 m from the lower end of the mold, and it is preferable not to arrange the casting product reduction apparatus in this range. Accordingly, the improvement effects in the center segregation and so on can be achieved by arranging the casting product reduction apparatus at a position of 2 m or more from the lower end of the mold and cooling the casting product so that the central solid phase ratio is 0 or more. Note that the range of the central solid phase ratio is not particularly limited, but may be a range of 0.2 to 1.0 as has been described, and may further be a range of 0.6 to 1.0 because the effects can be achieved even by applying reduction after solidification proceeds to a certain extent.

Figure 5:
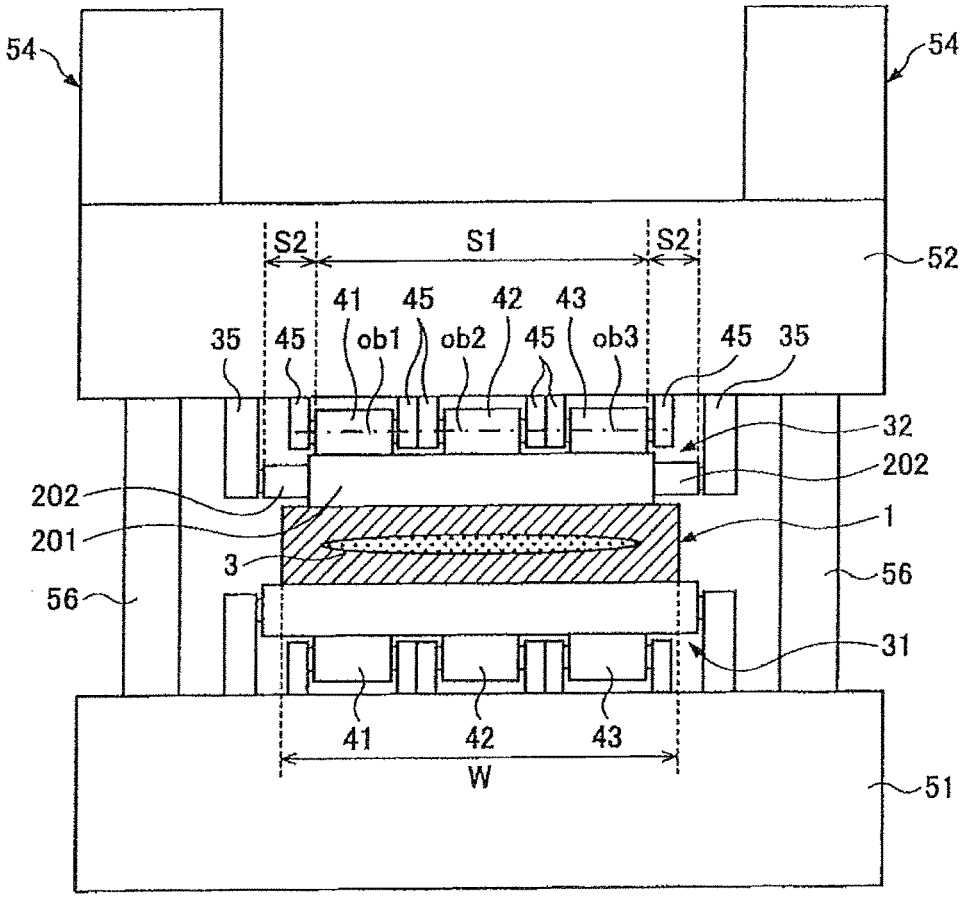
FIG. 5 A front explanatory view of a casting product reduction apparatus being another embodiment of the present invention.

Further, any one or both of the casting product press rolls 31, 32 forming a pair across the casting product 1 may be configured to include a large-diameter portion 201 projecting outward in the diameter direction at its middle portion in the axial direction and small-diameter portions 202 respectively located on both ends of the large-diameter portion 201 as illustrated in FIG. 5.

In this example, the width W of the casting product 1 is 900 mm or more, the one casting product press roll 31 is configured to press a middle region S1 in the width direction of the casting product 1 where the large-diameter portion 201 is located and not to press end regions S2 in the width direction of the casting product 1 where the small-diameter portions 202 are located.

Note that the end region S2 in the width direction of the casting product 1 is a region of 60 mm or more from the end in the width direction of the casting product 1 and 1.5×t or less from the end in the width direction of the casting product 1 where the thickness of the casting product 1 is t. In this example, the end region S2 is a region of 60 mm or more from the end in the width direction of the casting product 1 and 360 mm or less from the end in the width direction of the casting product 1.

The backup roll 40 that supports the one casting product press roll 32 is divided in the axial direction of the casting product press roll 32 (width direction of the casting product 1) and is divided into three parts, that is, a first backup roll 41, a second backup roll 42, and a third backup roll 43 as in the above-described embodiment.

Here, the backup roll 40 is arranged to support the large-diameter portion 201 of the casting product press roll 32.

Further, the first backup roll 41, the second backup roll 42, and the third backup roll 43 have both ends pivotally supported by pivotal support parts 45 and thereby be rotatable about their respective center axes $O_{b1}$, $O_{b2}$, $O_{b3}$.

Figure 6:
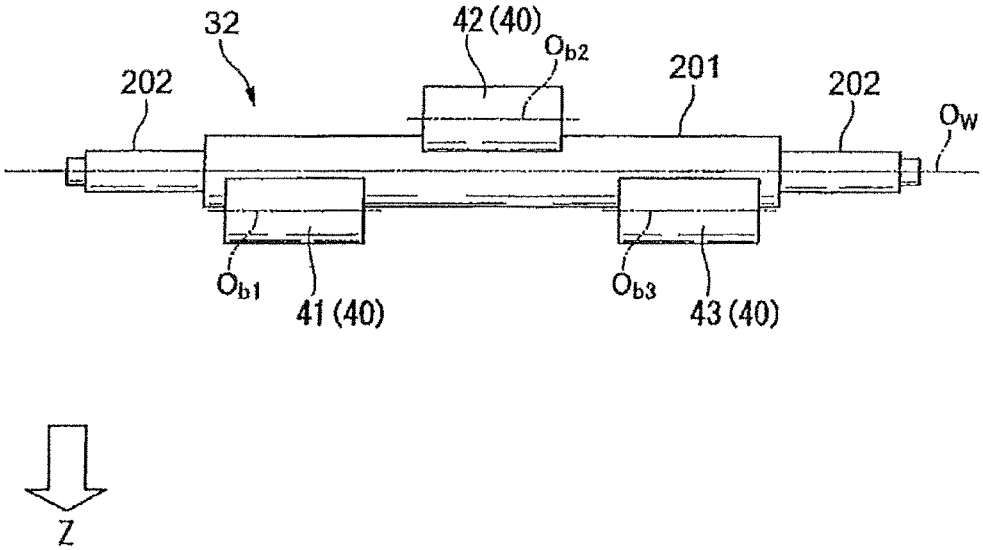
FIG. 6 A top explanatory view illustrating an arrangement example of divided backup rolls with respect to a casting product press roll.
Figure 7:
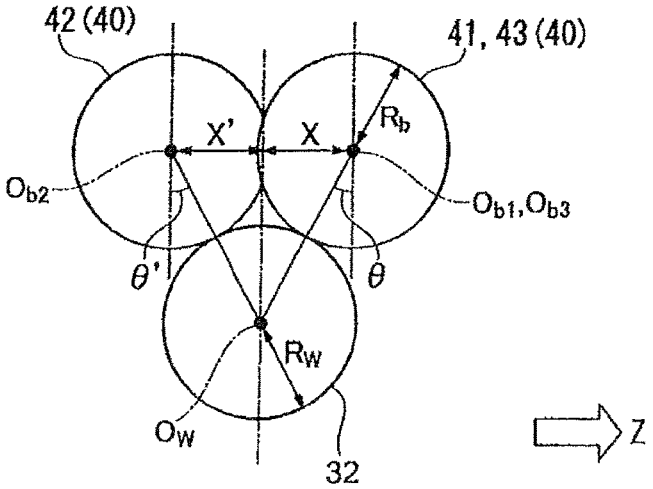
FIG. 7 A side explanatory view of the arrangement example illustrated in FIG. 6.

Here, as illustrated in FIG. 6 and FIG. 7, the first backup roll 41 and the third backup roll 43 may be arranged on the downstream side in the drawing direction Z of the casting product 1 with respect to the casting product press roll 31, 32. In this case, the second backup roll 42 is arranged on the upstream side in the drawing direction Z of the casting product 1 with respect to the casting product press roll 31, 32.

In other words, the first backup roll 41 and the third backup roll 43, and the second backup roll 42 may hold the casting product press roll 31, 32 therebetween in the drawing direction Z.

In this case, explaining the casting product press roll 32 as an example, in a cross section perpendicular to a center axis $O_w$ of the casting product press roll 32, an angle θ formed between a straight line linking the center axis $O_w$ of the casting product press roll 32 to the center axes $O_{b1}$, $O_{b3}$ of the first backup roll 41 and the third backup roll 43 and the rolling reduction direction (vertical direction) as illustrated in FIG. 7 is set to 5° or less.

Further, a difference amount X in the drawing direction Z between the center axis $O_w$ of the casting product press roll 32 and the center axes $O_{b1}$, $O_{b3}$ of the first backup roll 41 and the third backup roll 43 is set to be within a range of $\sin 0.23° \times (R_w+R_b) \leq X \leq \sin 5° \times (R_w+R_b)$. Note that $R_w$ is the radius of the large-diameter portion 201 of the casting product press roll 32, and $R_b$ is the radius of the backup roll 40.

In the case where a rolling reduction load F acts in the vertical direction on the casting product support roll, a load of F/cos θ that is the resultant force of the rolling reduction load F acting in the vertical direction and the load in the horizontal direction acts on the bearing parts of the backup roll arranged on the downstream side in the drawing direction of the casting product with respect to the casting product support roll. Here, the angle θ is set to θ≤5°, thereby making it possible to prevent the load acting on the bearing parts of the backup roll from becoming excessive so as to increase the life of the bearing parts of the backup roll.

Further, the angle θ is set to θ≥0.23°, thereby allowing the backup roll to surely receive the drawing resistance so as to suppress deflection deformation in the drawing direction of the casting product support roll.

Note that also for the second backup roll 42 arranged on the upstream side in the drawing direction Z with respect to the casting product press roll 32, in a cross section perpendicular to the center axis $O_w$ of the casting product press roll 32, an angle θ' formed between a straight line linking the center axis $O_w$ of the casting product press roll 32 to the center axis $O_{b2}$ of the second backup roll 42 and the reduction direction (vertical direction) is set to 5° or less, and a difference amount X' in the drawing direction Z between the center axis $O_w$ of the casting product press roll 32 and the center axis $O_{b2}$ of the second backup roll 42 is set to be within a range of $\sin 0.23° \times (R_w+R_b) \leq X' \leq \sin 5° \times (R_w+R_b)$.

In the continuous casting equipment 10 including the casting product rolling reduction apparatus 30 having the structure in which the large-diameter portion 201 projecting outward in the diameter direction is provided at the middle portion in the axial direction of the casting product press roll 32, the casting product 1 completely solidifies on the side subsequent to the horizontal zone 17 where the casting product 1 is drawn in the horizontal direction, and the horizontal roll part 27 at the horizontal zone 17 applies reduction to the casting product 1 as described in the above embodiment.

In this event, a force in the reduction direction (vertical direction in this embodiment) acts on the casting product press rolls 31, 32 due to the reduction reaction force. Further, a force in the drawing direction Z (horizontal direction in this embodiment) acts on the casting product press rolls 31, 32 due to the drawing resistance when the casting product 1 moves in the drawing direction Z.

Here, in the embodiment having the above structure, the casting product press roll 32 has the large-diameter portion 201 projecting outward in the diameter direction at its middle portion in the axial direction and the small-diameter portions 202 located on both ends of the large-diameter portion 201, and the casting product press roll 32 is configured to press the middle region S1 in the width direction of the casting product 1 where the large-diameter portion 201 is located and not to press the end regions S2 in the width direction of the casting product 1 where the small-diameter portions 202 are located, thereby making it possible to apply reduction only to the middle region S1 in the width direction of the casting product 1 where the unsolidified portion 3 exists. Thus, reduction load can be greatly reduced.

Further, since the casting product press roll 32 is supported by the backup roll 40, the deflection deformation of the casting product press roll 32 in the reduction direction can be suppressed.

Further, since the small-diameter portions 202 of the casting product press roll 32 are located at the completely solidified end regions S2 in the width direction of the casting product 1, the drawing resistance acts only on the middle region S1 in the width direction where the unsolidified portion 3 exists, so that the deflection deformation in the drawing direction of the casting product press roll 32 can also be prevented.

Here, in this embodiment, the end region S2 in the width direction of the casting product 1 where the small-diameter portion 202 is located is a region of 60 mm or more from the end in the width direction of the casting product 1 and 1.5×t or less from the end in the width direction to the center side of the casting product 1, where the thickness of the casting product 1 is t. Specifically, a region of 60 mm or more from the end in the width direction of the casting product 1 and 360 mm or less from the end in the width direction of the casting product 1 can be exemplified. This makes it possible to avoid application of reduction to the completely solidified region so as to surely reduce the reduction load. Further, the deflection deformation in the reduction direction and the deflection deformation in the drawing direction of the casting product press roll 31 can be suppressed.

Further, since the backup roll 40 is divided into the first backup roll 41, the second backup roll 42, and the third backup roll 43 in the axial direction of the casting product press roll 32, the axial direction length of the backup roll 40 can be decreased and stiffness can be secured even with a small roll diameter.

Here, the first backup roll 41 and the third backup roll 43 are arranged on the downstream side in the drawing direction Z of the casting product 1 with respect to the casting product press roll 31, 32, so that the first backup roll 41 and the third backup roll 43 can receive the drawing resistance so as to suppress the deflection deformation in the drawing direction of the casting product press roll 31, 32.

Furthermore, the second backup roll 42 is arranged on the upstream side in the drawing direction Z of the casting product 1 with respect to the casting product press roll 31, 32, and the first backup roll 41 and the third backup roll 43, and the second backup roll 42 hold the casting product press roll 31, 32 therebetween in the drawing direction Z, thereby suppressing occurrence of bending variation in the casting product press roll 31, 32 even if the casting speed (drawing speed of the casting product) is changed depending on the operation status.

Furthermore, it is preferable to set the difference amount X in the drawing direction Z between the center axis $O_w$ of the casting product press roll 32 and the center axes $O_{b1}$, $O_{b3}$ of the first backup roll 41 and the third backup roll 43 to $\sin 0.23° \times (R_w+R_b) \leq X$ as described above. This makes it possible to surely transmit the drawing resistance applied on the casting product press roll 32 to the first backup roll 41 and the third backup roll 43 so as to prevent the deflection deformation in the drawing direction Z of the casting product press roll 32.

Further, it is preferable to set the difference amount X to $X \leq \sin 5° \times (R_w+R_b)$. In the cross section perpendicular to the center axis $O_w$ of the casting product press roll 32, the angle θ formed between the straight line linking the center axis $O_w$ of the casting product press roll 32 to the center axes $O_{b1}$, $O_{b3}$ of the first backup roll 41 and the third backup roll 43 and the reduction direction (vertical direction in this embodiment) is se to 45° or less, so that it is possible to transmit the load in the reduction direction to the first backup roll 41 and the third backup roll 43 so as to suppress the deflection deformation in the reduction direction of the casting product press roll 32.

Further, it is preferable that, also for the second backup roll 42 arranged on the upstream side in the drawing direction Z with respect to the casting product press roll 32, the difference amount X' in the drawing direction Z between the center axis $O_w$ of the casting product press roll 31 and the center axis $O_{b2}$ of the second backup roll 42 is set to be within a range of $\sin 0.23° \times (R_w+R_b) \leq X' \leq \sin 5° \times (R_w+R_b)$, and in the cross section perpendicular to the center axis $O_w$ of the casting product press roll 32, the angle θ' formed between the straight line linking the center axis $O_w$ of the casting product press roll 32 to the center axis $O_{b2}$ of the second backup roll 42 and the reduction direction (vertical direction in this embodiment) is set to 5° or less, thereby making it possible to suppress the bending variation in the drawing direction Z of the casting product press roll 32 and receive the load in the reduction direction by the second backup roll 42.

Though the backup rolls are described as being arranged on the downstream side and the upstream side with respect to the casting product press rolls in the above example, but the backup rolls are not limited to this and may be arranged only on the downstream side in the drawing direction with respect to the casting product press rolls or may be arranged such that the center axes of the casting product press rolls are located at the same position as those of the backup rolls in the drawing direction.

Furthermore, the casting product press roll 32 that is one of the casting product press rolls 31, 32 forming a pair across the casting product is described as having the large-diameter portion 201 in the above example, but not limited to this, and both of the casting product press rolls 31, 32 forming a pair across the casting product may have respective large-diameter portions.

In the present invention, the width of a target casting product is preferably 900 mm or more.

Even for a wide casting product of 900 mm or more, the deflection deformation in the reduction direction of the casting product press rolls 31, 32 can be suppressed because the casting product press rolls 31, 32 are supported by the backup rolls. Further, the deflection deformation in the drawing direction of the casting product press rolls 31, 32 can also be suppressed. Accordingly, it becomes possible to surely apply reduction to the middle portion in the width direction of the casting product 1 to suppress occurrence of internal defects such as center segregation and porosity due to bulging deformation.

EXAMPLES

Hereinafter, results of an experiment carried out to confirm the effects of the present invention will be described.

In this experiment, two casting product reduction apparatuses illustrated in each of FIG. 8 to FIG. 12 were sequentially installed in the drawing direction of the casting product at the horizontal zone of the vertical bending continuous casting machine illustrated in FIG. 1 and applied reduction to a casting product during casting, and a reduction force index, a bulging index, a center segregation index, and a porosity index were evaluated.

The size of the casting product was 300 mm thick×2200 mm wide, the casting speed was 0.9 m/min, and the two casting product reduction apparatuses were sequentially installed in the drawing direction of the casting product from a position of 22 m from the bottom of the mold so that the central solid phase ratio of the casting product where the casting product reduction apparatuses were installed was in a range of 0.2 to 1.0.

Further, the roll diameter of the casting product press roll and the backup roll was 270 mm and seven sets of casting product press rolls were arranged on the frames in the drawing direction of the casting product. Further, the first frame and the second frame were coupled to each other by four reduction means (hydraulic cylinders).

Figure 8:
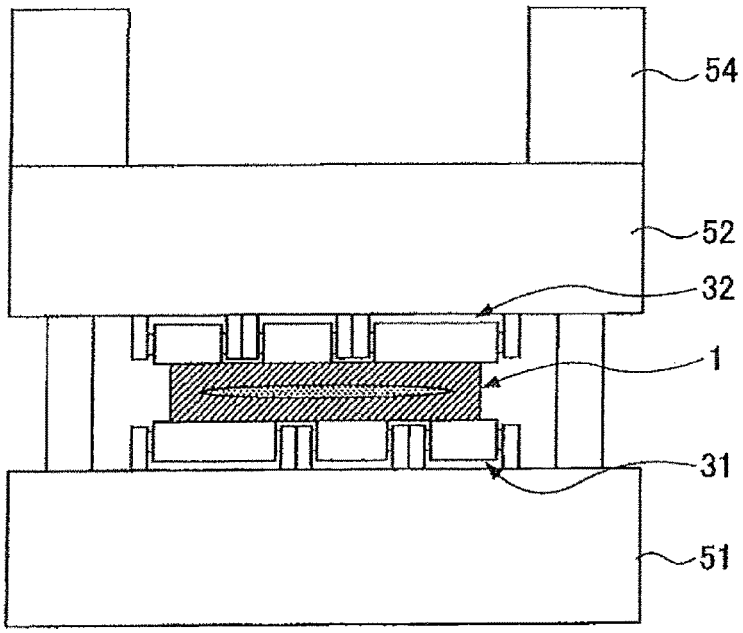
FIG. 8 A front explanatory view of a casting product reduction apparatus in a conventional example compared with examples.

As a conventional example, a casting product reduction apparatus having a structure in which there was no backup roll and a casting product press roll 31, 32 was divided into three parts in the roll axial direction as illustrated in FIG. 8 was used.

Figure 9:
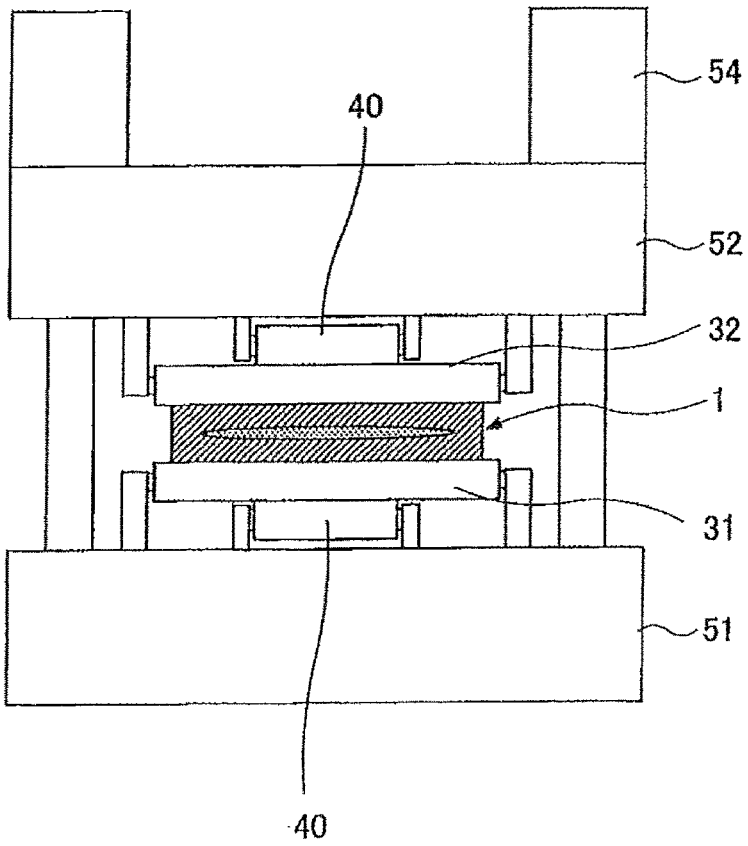
FIG. 9 A front explanatory view of a casting product reduction apparatus in Present Invention Example 1 in examples.

As Present Invention Example 1, a casting product reduction apparatus having a structure in which casting product press rolls 31, 32 having roll axial direction lengths larger than the width of the casting product were provided and one backup roll was arranged for each one of the casting product press rolls as illustrated in FIG. 9 was used.

Figure 10:
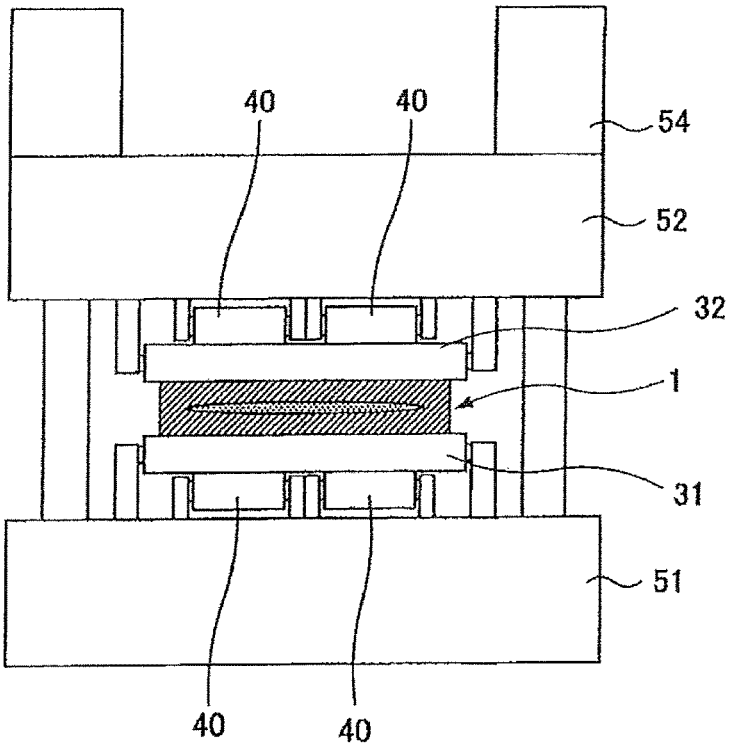
FIG. 10 A front explanatory view of a casting product reduction apparatus in Present Invention Example 2 in examples.

As Present Invention Example 2, a casting product reduction apparatus having a structure in which casting product press rolls 31, 32 having roll axial direction lengths larger than the width of the casting product were provided and a backup roll 40 divided into two parts in the roll axial direction was arranged for each one of the casting product press rolls as illustrated in FIG. 10 was used.

Figure 11:
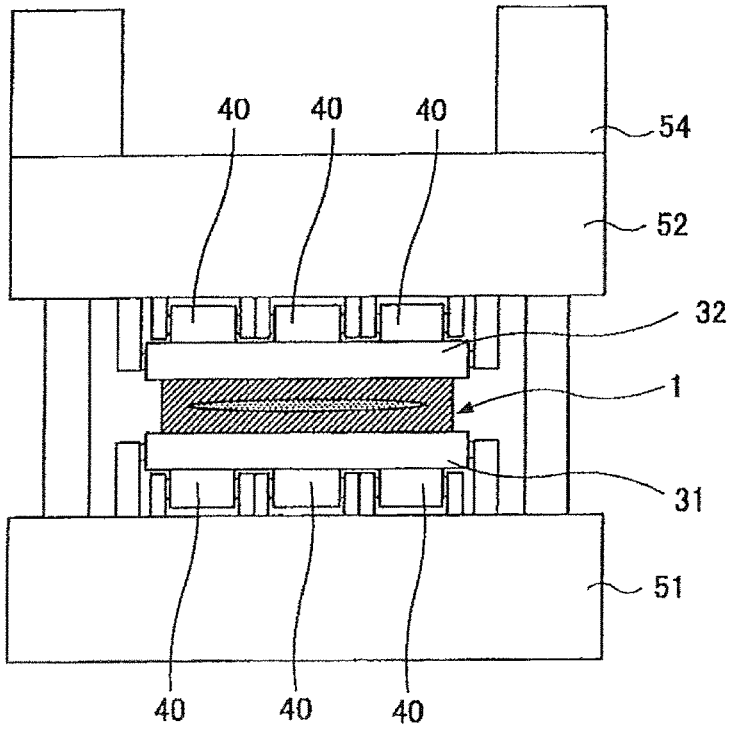
FIG. 11 A front explanatory view of a casting product reduction apparatus in Present Invention Example 3 in examples.

As Present Invention Example 3, a casting product reduction apparatus having a structure in which casting product press rolls 31, 32 having roll axial direction lengths larger than the width of the casting product were provided and a backup roll 40 divided into three parts in the roll axial direction was arranged for each one of the casting product press rolls as illustrated in FIG. 11 was used.

Figure 12:
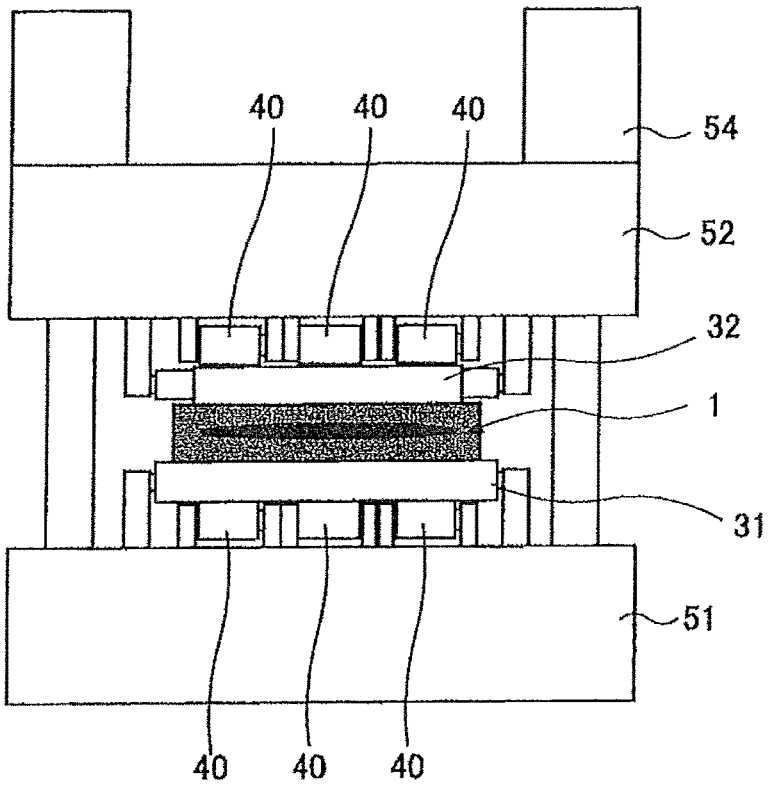
FIG. 12 A front explanatory view of a casting product reduction apparatus in Present Invention Example 4 in examples.

As Present Invention Example 4, a casting product reduction apparatus having a structure in which casting product press rolls 31, 32 having roll axial direction lengths larger than the width of the casting product were provided, the casting product press roll 32 on the upper side had a large-diameter portion projecting outward in the diameter direction at the middle portion in the axial direction, and a backup roll 40 divided into three parts in the roll axial direction was arranged for each one of the casting product press rolls as illustrated in FIG. 12 was used. The roll diameter of the large-diameter portion pressing the casting product was 270 mm and the roll diameter of the other portion was 255 mm. The length of the large-diameter portion was 1900 mm. The range of the large-diameter portion supported by a plurality of backup rolls was 1890 mm.

Note that the reduction force index when evaluating the experimental result was obtained by adjusting the reduction force so that the largest value of the distributed load on each bearing (each bearing of the casting product press rolls and each bearing of the backup rolls) measured by a load cell arranged under the bearing during casting satisfies the following Expression (1) and using the value in the conventional example as a standard.

$$\text{(basic static load rating of the bearing)/(distributed load on the bearing)}=5.0 \quad (1)$$

Namely, the value of 5.0 in Expression (1) was set because 5.0 was within the appropriate range of the load on the bearing from the operation actual performance.

The reduction amount index was obtained by measuring the thickness of the casting product after casting, finding the difference in thickness between the case of applying the reduction and the case of not applying the reduction as a reduction amount applied to the casting product, and indicating the reduction amount in a relative value using the reduction amount in the conventional example as a standard.

The bulging index was obtained by evaluating the maximum value of the deformation amount in the thickness direction of the casting product using finite element method analysis and indicating the maximum value in a relative value using the value in the conventional example as a standard.

The center segregation index was obtained from the following Expression (2).

$$\text{(casting product Mn segregation degree)/((casting product Mn segregation degree in conventional example)}-1) \quad (2)$$

Here, the casting product Mn segregation degree is (maximum value of Mn concentration of Mn segregation part)/(Mn concentration of the whole casting product) and was measured in the following procedure.

Samples of 50 mm×50 mm were obtained mainly from middle portions in the thickness direction of the casting product at 10 places, which are positions uniformly divided along the width direction of the casting product, and the surfaces of the samples were polished and then subjected to line analysis with X ray in the thickness direction of the casting product for measurement of the peak values of the Mn concentrations, which were regarded as the Mn concentrations of the Mn segregation parts. As the Mn concentration of the whole casting product, the value obtained by analysis and measurement at the stage of molten steel was used.

The porosity index was obtained by cutting a sample with a thickness of 20 mm including the middle portion in the thickness direction from the casting product, finding a total cross section area of the porosity with respect to the cross section area in the thickness direction of the casting product by X-ray transmission photography, and indicating the total cross section area in a relative value using the area ratio in the conventional example as a standard.

Figure 13:
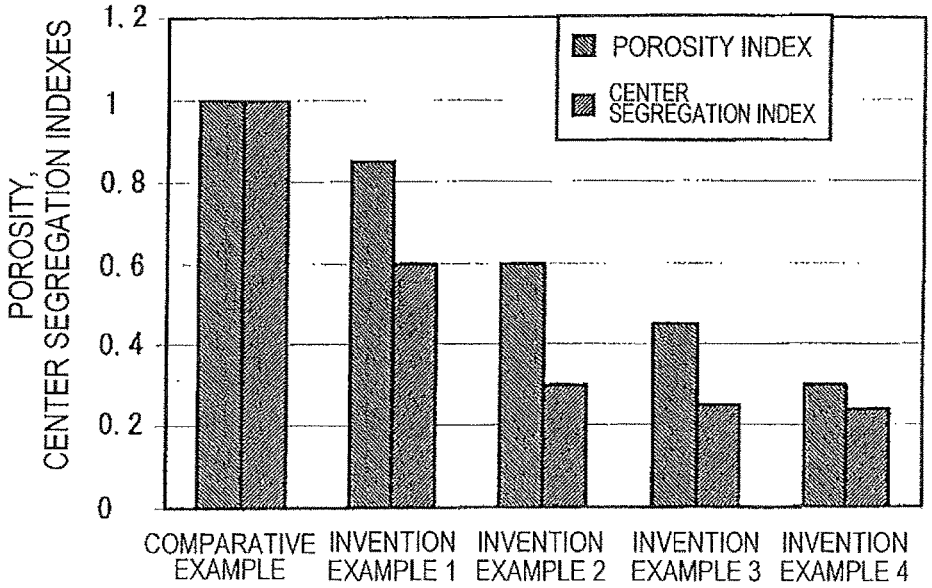
FIG. 13 A graph illustrating evaluation results of the examples.

The evaluation results are illustrated in Table 1 and FIG. 13.

TABLE 1

| Casting results | | | | | |
|---|---|---|---|---|---|
| | reduction force index | reduction amount index | bulging index | porosity index | center segregation index |
| Comparative Example | 1 | 1.0 | 1 | 1 | 1 |
| Invention Example 1 | 0.85 | 0.9 | 0.60 | 0.85 | 0.60 |
| Invention Example 2 | 1.20 | 1.3 | 0.60 | 0.60 | 0.30 |
| Invention Example 3 | 1.50 | 1.8 | 0.60 | 0.45 | 0.25 |
| Invention Example 4 | 1.40 | 2.4 | 0.60 | 0.30 | 0.24 |

In Present Invention Example 1, since the number of bearings was smaller than that in the conventional example, the load distributed to each bearing increased and the reduction force index decreased. However, since the casting product press rolls were not divided, any roll-unsupported zone was eliminated in the width direction of the casting product and the bulging index decreased. Thus, the porosity index decreased by 15%, and the center segregation index decreased by 40% degrees.

In Present Invention Example 2, since the backup roll was divided into two parts, the load distributed to each bearing decreased and the reduction force index could be increased as compared with the conventional example. Further since the bulging index decreased to the same level as that in Present Invention Example 1 and the reduction force index increased, the reduction amount compensating for solidification shrinkage seemed to be given to the casting product, and the porosity index decreased by 40% and the center segregation index decreased by 70%.

In Present Invention Example 3, since the backup roll was divided into three parts, the reduction force index could further be increased. Thus, the reduction amount of the casting product further increased, and the porosity index decreased by 55% and the center segregation index decreased by 75%.

In Present Invention Example 4, since the backup roll was divided into three parts, the load distributed to each bearing decreased and the reduction force index could be increased as compared with Invention Example 2. However, since the reduction was applied to a smaller range, the load distributed to a specific bearing increased and the reduction force index slightly decreased as compared with Invention Example 3. However, since the rolling reduction to the end portion of the casting product where the deformation resistance was high could be avoided, the reduction amount increased, the porosity index decreased by 70%, and the center segregation index decreased by 76%.

As described above, it was confirmed that according to Present Invention Examples 1 to 4, the center segregation and the porosity were simultaneously improved as compared with those of the conventional example. Further, it was found that in the case where the casting product press roll included a large-diameter portion, the center segregation and the porosity were decreased to the utmost extent.

Note that the results obtained by calculating the deflection amounts in the reduction direction and the drawing direction of the casting product press roll using finite element method analysis, in order to confirm the effects achieved by the structure in which the above-described casting product press roll 32 has the large-diameter portion 201 projecting outward in the diameter direction at its middle portion in the axial direction and the small-diameter portions 202 respectively located on both ends of the large-diameter portion 201, will be described as a reference example (casting product press roll unit).

Figure 14:
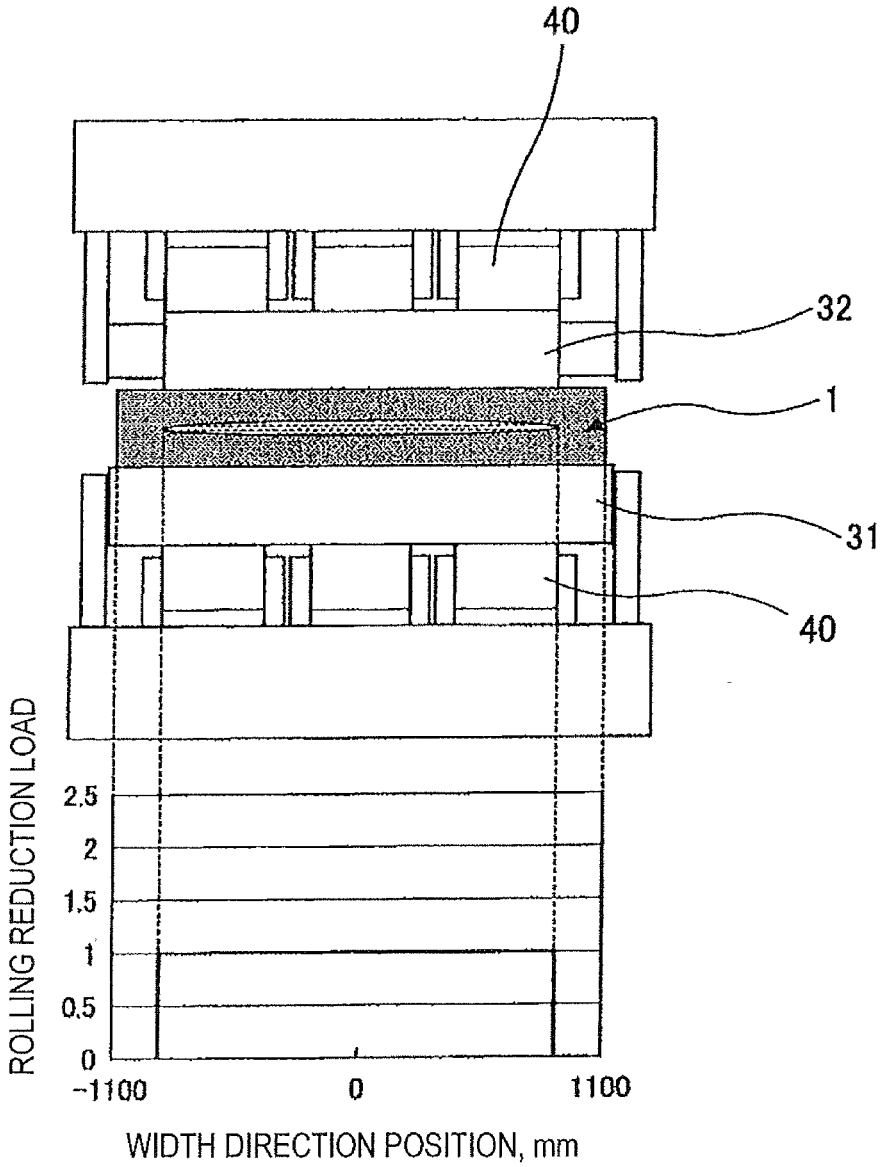
FIG. 14 A schematic cross-sectional explanatory view of a casting product press roll unit in a case (1) evaluated in a reference example.
Figure 15:
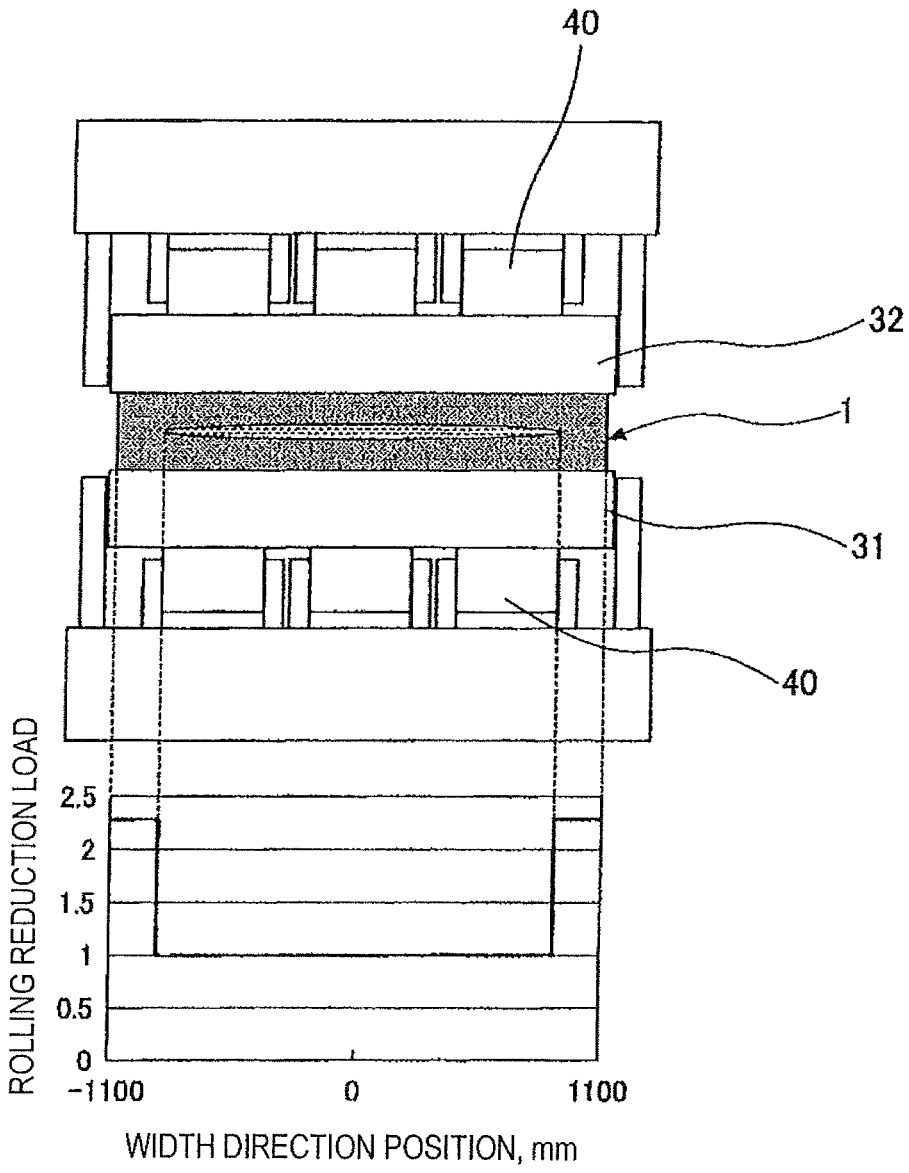
FIG. 15 A schematic cross-sectional explanatory view of a casting product press roll unit in a case (2) evaluated in a reference example.
Figure 16:
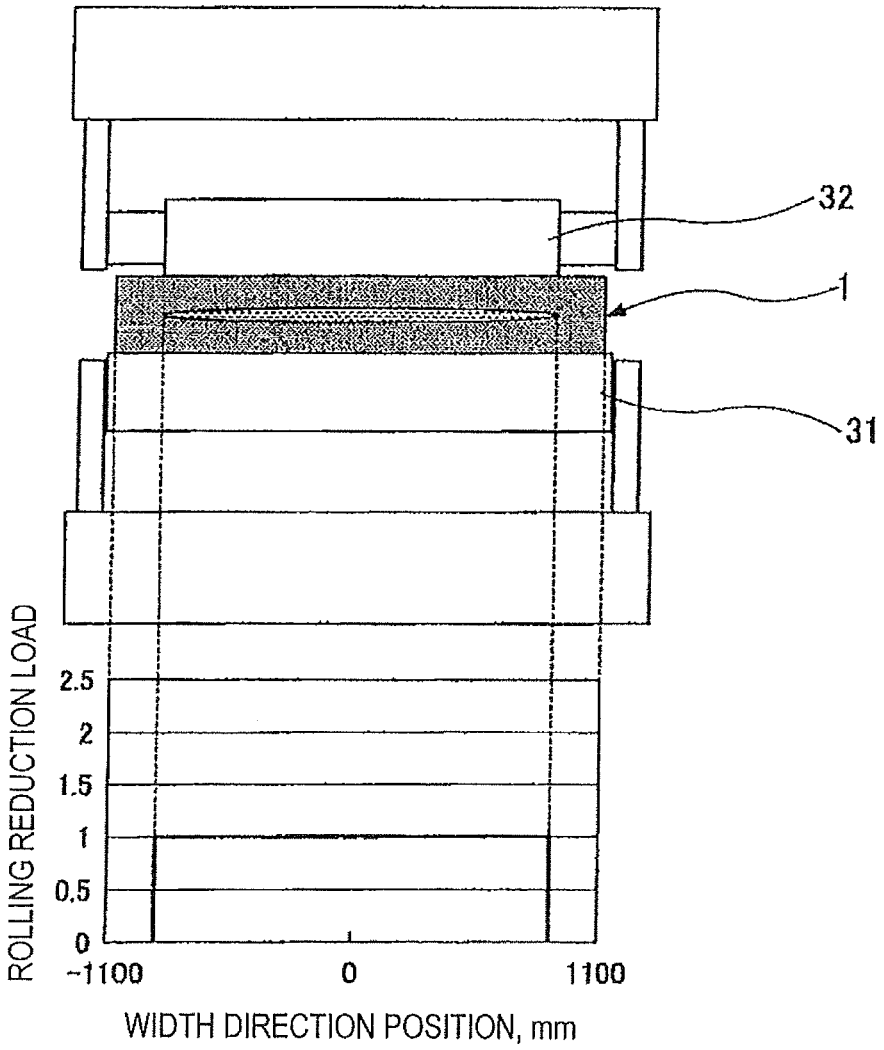
FIG. 16 A schematic cross-sectional explanatory view of a casting product press roll unit in a case (3) evaluated in a reference example.

The deflection amount of the casting product press roll in the reduction direction was evaluated in the following cases:

a case (1) in which only one (upper side) of casting product press rolls forming a pair across the casting product has a large-diameter portion at the middle portion in the axial direction, and a backup roll supporting the casting product press roll is provided;

a case (2) in which casting product press rolls do not have a large-diameter portion at the middle portion in the axial direction, but backup rolls supporting the casting product press rolls are provided; and a case (3) in which only one (upper side) of casting product press rolls forming a pair across the casting product has a large-diameter portion at the middle portion in the axial direction, but a backup roll supporting the casting product press roll is not provided. The outlines of the cases (1), (2), (3) are illustrated in FIG. 14, FIG. 15, FIG. 16. In each of the drawings, the reduction load in each case is illustrated.

Here, each bearing of the roll was fixed by a plate being an elastic body. The thickness of the plate was 40 mm, and the height of the plate was 500 mm. The roll diameter was ϕ 300 mm, and a cooling water hole of 50 mm was bored. The size of the casting product was 300 mm thick×2200 mm wide. It was obtained by calculation that when the reduction was applied to the casting product having the cross section by 0.6 mm per casting product press roll, the average drawing resistance in the range of 200 mm from the end in the width direction of the casting product was about 2.3 times the drawing resistance by a molten steel static pressure of the unsolidified portion. The end region in the width direction of the casting product which was not subjected to the reduction by the large-diameter portion of the casting product press roll in (1), (3) was 200 mm on either side. Note that in each case (1), (2), (3), the center axis of the casting product press roll and the center axis of the backup roll coincide each other in the drawing direction.

Figure 17:
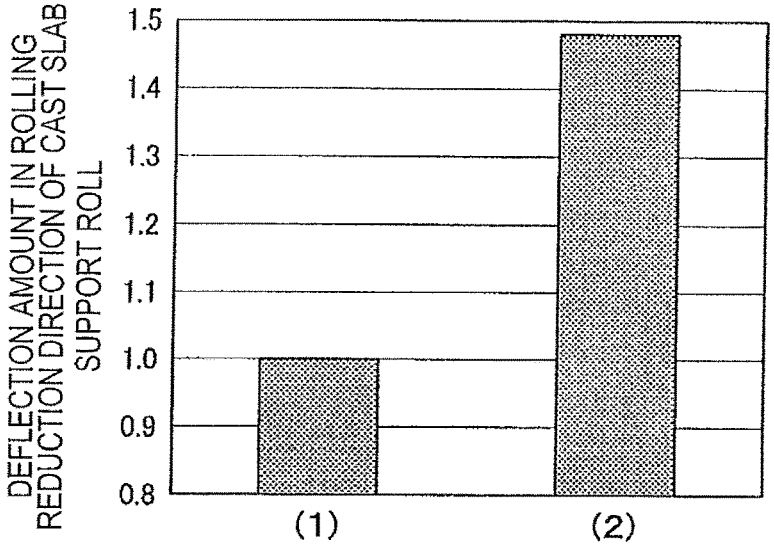
FIG. 17 A graph illustrating the deflection amounts in a reduction direction of the casting product press rolls calculated in the reference cases.

The calculation results are illustrated in FIG. 17. From the comparison between (1) and (2), it was confirmed that only one (upper side) of the casting product press rolls forming a pair across the casting product having a large-diameter portion at the middle portion in the axial direction could decrease the reduction load acting on both of the casting product press rolls forming a pair to suppress the deflection deformation of both of the casting product press rolls forming a pair down to about two thirds. Thus, the life until permanent deformation occurs in the casting product press rolls can be greatly increased. Further, a high-quality casting product can be manufactured which has less internal defects such as center segregation and porosity due to bulging deformation caused by the deformation of the casting product press rolls.

Further, from the comparison between (1) and (3), it was confirmed that the backup roll arranged at plate-shaped frame with high stiffness supporting the casting product press roll could suppress the deflection deformation of the casting product press roll down to about one sixth. Note that in the comparison between (1) and (2) and the comparison between (1) and (3), the same effects can be achieved even in the case where only the other (lower side) of the casting product press rolls forming a pair has a large-diameter portion.

Next, the deflection amount of the casting product press roll in the drawing direction was evaluated in the following cases:

a case (4) in which only one (upper side) of the casting product press rolls forming a pair across the casting product has a large-diameter portion at the middle portion in the axial direction, and the axis of the backup roll and the axis of the casting product press roll coincide each other in the drawing direction;

a case (5) in which the casting product press roll does not have a large-diameter portion at the middle portion in the axial direction, and the axis of the backup roll and the axis of the casting product press roll coincide each other in the drawing direction; and a case (6) in which only one (upper side) of the casting product press rolls forming a pair across the casting product has a large-diameter portion at the middle portion in the axial direction, and one of the backup rolls is arranged on the downstream side in the drawing direction.

Figure 18:
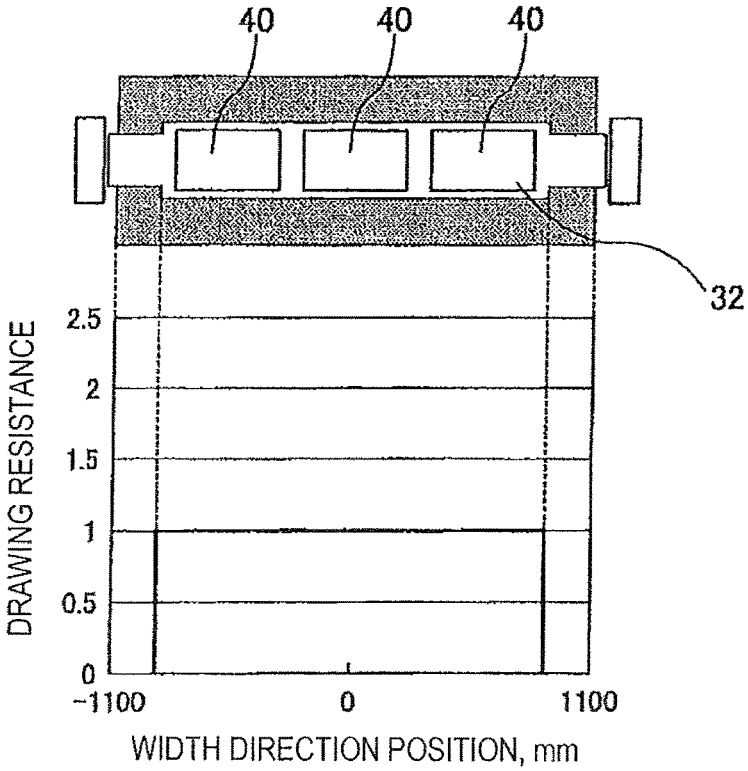
FIG. 18 A schematic top explanatory view of a casting product press roll unit in a case (4) evaluated in a reference example.
Figure 19:
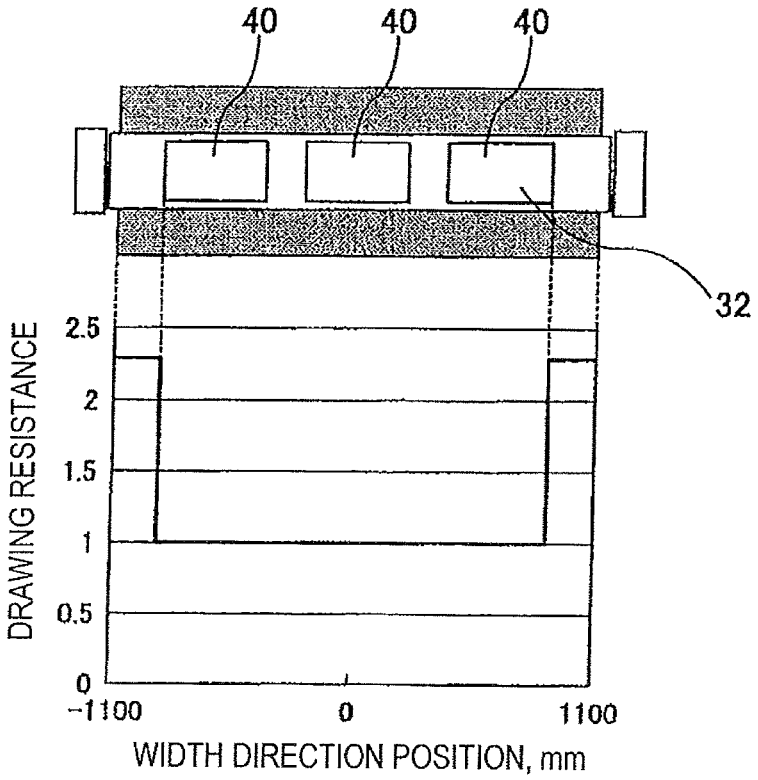
FIG. 19 A schematic top explanatory view of a casting product press roll unit in a case (5) evaluated in a reference example.
Figure 20:
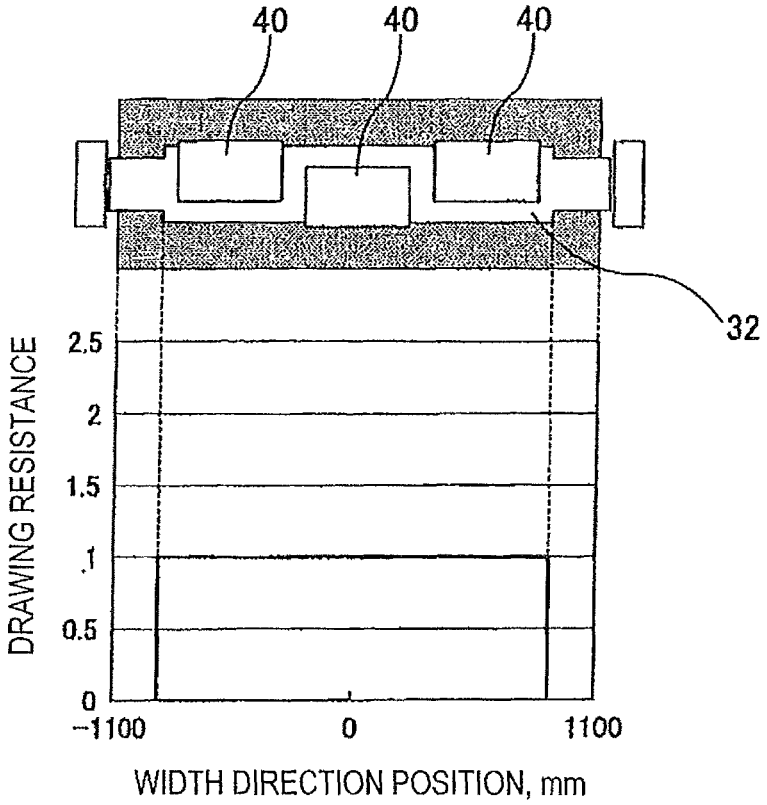
FIG. 20 A schematic top explanatory view of a casting product press roll unit in a case (6) evaluated in a reference example.

The outlines of the cases (4), (5), (6) are illustrated in FIG. 18, FIG. 19, FIG. 20.

Figure 21:
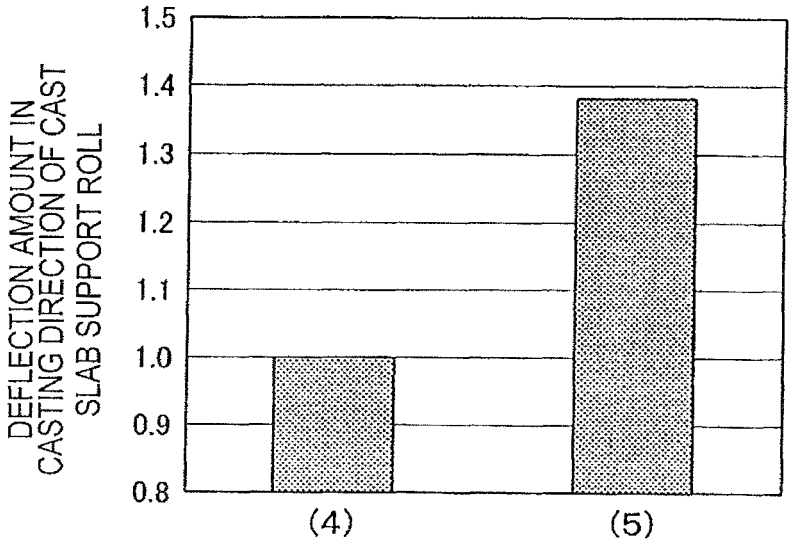
FIG. 21 A graph illustrating the deflection amounts in a drawing direction of the casting product press rolls calculated in the reference cases.

The calculation results are illustrated in FIG. 21. From the comparison between (4) and (5), it was confirmed that only one (upper side) of the casting product press rolls forming a pair across the casting product having a large-diameter portion at the middle portion in the axial direction could decrease the reduction load acting on both of the casting product press rolls forming a pair and, as a result, decrease the drawing resistance because the drawing resistance was proportional to the reduction load, and suppress the deflection deformation in the drawing direction of the casting product press rolls by about three out of ten. Thus, the life until permanent deformation occurs in the casting product press rolls can be greatly increased. Further, a high-quality casting product can be manufactured which has less internal defects such as center segregation and porosity due to bulging deformation caused by the deformation of the casting product press rolls.

Further, it was confirmed that in the case where one of the backup rolls was arranged on the downstream side in the drawing direction as in (6), the places for supporting the drawing resistance increased as compared with the case (4), the deflection deformation of the casting product press rolls could be suppressed down to about one eighth. Note that in the comparison between (4) and (5) and the comparison between (4) and (6), the same effects can be achieved also in the case where the other (lower side) of the casting product press rolls forming a pair has a large-diameter portion.

Figure 22:
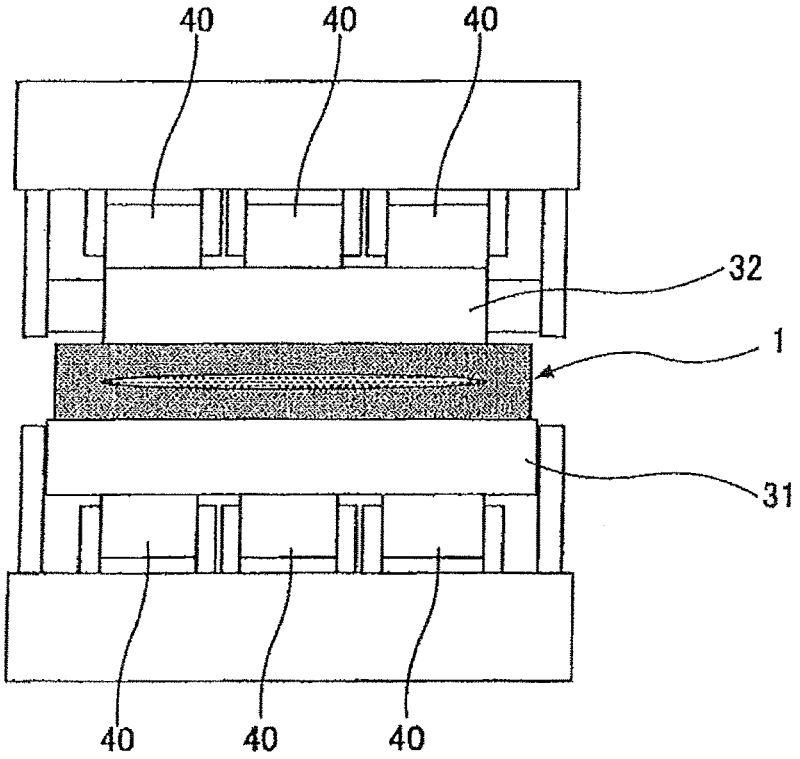
FIG. 22 A schematic top explanatory view of a casting product press roll unit in a case (7) evaluated in a reference example.
Figure 23:
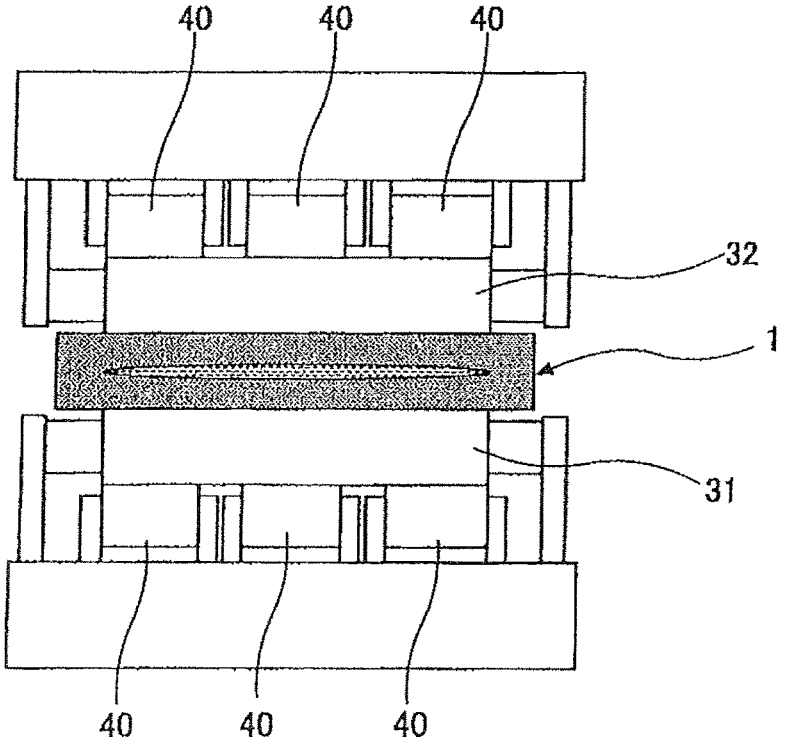
FIG. 23 A schematic top explanatory view of a casting product press roll unit in a case (8) evaluated in a reference example.

Next, an internal crack occurrence rate when applying reduction to the casting product in the process of solidification by a roll at one place was experimentally evaluated about a case (7) in which only one (upper side) of the casting product press rolls forming a pair across the casting product had a large-diameter portion at the middle portion in the axial direction and a case (8) in which both of the casting product press rolls forming a pair across the casting product had respective large-diameter portions at the middle portions in the axial direction. The outlines of the cases (7), (8) are illustrated in FIG. 22, FIG. 23.

Here, the internal crack occurrence rate indicates the probability that the internal crack was visually confirmed at one or more places on an etch print in a cross section in the casting direction of a randomly selected casting product. The experiment conditions and the results of the internal crack occurrence rate are illustrated in Table 2.

TABLE 2

| | casting product width (mm) | casting product thickness (mm) | casting speed (m/min) | reduction amount per roll (mm) | internal crack occurrence rate (%) |
|---|---|---|---|---|---|
| (7) | 2200 | 240 | 0.8-1.2 | 1.0 | 4.0 |
| (8) | 2200 | 240 | 0.8-1.2 | 1.0 | 0.5 |

It was confirmed that in the case where the roll having a large-diameter portion was arranged only on one side of the casting product, the casting product was subjected to reduction from the one side with a large reduction amount, whereas in the case where the rolls having respective large-diameter portions were arranged on both sides of the casting product, the casting product was subjected to reduction from both sides with a small reduction amount and therefore the internal crack occurrence rate was extremely small.

EXPLANATION OF CODES

1 casting product
10 continuous casting equipment
11 water-cooled mold
30 casting product reduction apparatus
31, 32 casting product press roll
40 backup roll
51, 151 first frame
52, 152 second frame
54, 154 rolling reduction means

What is claimed is:

1. A casting product reduction apparatus for applying reduction to a casting product drawn from a mold, comprising:

a pair of casting product press rolls that hold and press the casting product therebetween;

backup rolls that support the casting product press rolls; and a pair of frames arranged to face each other, each of the backup rolls supporting only a respective one of the pair of casting product press rolls and forming a set including the backup roll and the respective one of the pair of casting product press rolls, wherein three or more sets of the casting product press roll and the backup roll are arranged in a casting product drawing direction on each of the frames, wherein a reduction means that decreases and increases a distance between the pair of frames is provided at two or more places on the pair of frames, and wherein at least one of the casting product press rolls forming a pair across the casting product has a large-diameter portion having a diameter that is larger than a diameter portion of a small diameter portion of the at least one of the casting product press rolls, the larger-diameter portion projecting outward in a diameter direction at a middle portion in an axial direction, and wherein where a thickness of the casting product is t, an end region in a width direction of the casting product which is not subjected to reduction by the large-diameter portion of the casting product press roll is a region of 60 mm or more from an end in the width direction of the casting product and 1.5×t or less from the end in the width direction of the casting product.

2. The casting product reduction apparatus according to claim 1, wherein the backup roll is divided into a plurality of parts in an axial direction of the casting product press roll.

3. The casting product reduction apparatus according to claim 1, wherein the backup roll is arranged on a downstream side in a drawing direction of the casting product with respect to the casting product press roll.

4. The casting product reduction apparatus according to claim 1, wherein the backup roll is divided in an axial direction of the casting product press roll, and at least one backup roll is arranged on a downstream side in a drawing direction of the casting product and at least one backup roll is arranged on an upstream side in the drawing direction of the casting product.

5. The casting product reduction apparatus according to claim 4, wherein difference amount X in the drawing direction between a center axis of the casting product press roll and a center axis of the backup roll arranged on the downstream side is set to $\sin 0.23° \times (Rw+Rb) \leq X \leq \sin 5° \times (Rw+Rb)$ in which Rw is a radius of the large-diameter portion and Rb is a radius of the backup roll.

6. The casting product reduction apparatus according to claim 1, wherein each backup roll is divided into a plurality of parts in an axial direction of the casting product press rolls, each of said parts having a respective individual rotation axis, wherein bearings of the divided backup rolls have no interval therebetween in an axial direction.

7. The casting product reduction apparatus according to claim 6, wherein difference amount X' in the drawing direction between a center axis of the casting product press roll and a center axis of the backup roll arranged on the upstream side is set to $\sin 0.23° \times (R_w+R_b) \leq X' \leq \sin 5° \times (R_w+R_b)$.

* * * * *